US008110332B2

(12) United States Patent
Suzuki et al.

(10) Patent No.: US 8,110,332 B2
(45) Date of Patent: Feb. 7, 2012

(54) ELECTROPHOTOGRAPHIC TONER AND METHOD FOR PRODUCING THE ELECTROPHOTOGRAPHIC TONER

(75) Inventors: Kazumi Suzuki, Shizuoka (JP); Yohichiroh Watanabe, Fuji (JP); Takahiro Honda, Fujinomiya (JP); Yoshihiro Norikane, Yokohama (JP); Shinji Ohtani, Shizuoka (JP); Tsuyoshi Sugimoto, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 865 days.

(21) Appl. No.: 12/036,706

(22) Filed: Feb. 25, 2008

(65) Prior Publication Data

US 2008/0292985 A1 Nov. 27, 2008

(30) Foreign Application Priority Data

Feb. 28, 2007 (JP) ..... 2007-049530
Oct. 9, 2007 (JP) ..... 2007-262899

(51) Int. Cl.
*G03G 9/08* (2006.01)

(52) U.S. Cl. ..... 430/137.1

(58) Field of Classification Search ..... 430/137.1
See application file for complete search history.

(56) References Cited

U.S. PATENT DOCUMENTS

| | | | | |
|---|---|---|---|---|
| 5,641,602 | A * | 6/1997 | Maris et al. | 430/108.8 |
| 2003/0224271 | A1* | 12/2003 | Teshima | 430/105 |
| 2006/0210909 | A1* | 9/2006 | Ohtani | 430/137.1 |

FOREIGN PATENT DOCUMENTS

| | | |
|---|---|---|
| JP | 5-119531 | 5/1993 |
| JP | 7-152202 | 6/1995 |
| JP | 10-319627 | 12/1998 |
| JP | 3166369 | 3/2001 |
| JP | 2003-262976 | 9/2003 |
| JP | 2003-262977 | 9/2003 |
| JP | 2003-280236 | 10/2003 |
| JP | 2004-157267 | 6/2004 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Oblon, Spivak, McClelland, Maier & Neustadt, L.L.P.

(57) ABSTRACT

Provided are an electrophotographic toner and a method for producing the electrophotographic toner that satisfy high image quality, cleaning stability, and high productivity.
The electrophotographic toner is produced by spray-drying a toner ingredient-containing liquid, wherein the toner ingredient-containing liquid dissolves or disperses at least a resin, a low molecular mass organic material, and a colorant in an organic solvent, the resin is soluble in the organic solvent, the low molecular mass organic material is a crystalline compound or a composition of crystalline compounds that is soluble in the organic solvent, the toner ingredient-containing liquid contains substantially no particles having a particle diameter of 500 nm or more, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

10 Claims, 16 Drawing Sheets

FOREIGN PATENT DOCUMENTS

| | | |
|---|---|---|
| JP | 2005-258394 | 9/2005 |
| JP | 2005-301060 | 10/2005 |
| JP | 2006-36820 | 2/2006 |
| JP | 2006-106288 | 4/2006 |
| JP | 2007-199463 | 8/2007 |

OTHER PUBLICATIONS

U.S. Appl. No. 11/851,475, filed Sep. 7, 2007, Yohichiroh Watanabe, et al.
U.S. Appl. No. 12/187,717, filed Aug. 7, 2008, Suzuki, et al.

* cited by examiner

ELECTROPHOTOGRAPHIC TONER AND METHOD FOR PRODUCING THE ELECTROPHOTOGRAPHIC TONER

BACKGROUND OF THE INVENTION

1. Field of the Invention

The present invention relates to an electrophotographic toner used for electrophotography, more specifically to an electrophotographic toner that is produced by spray processes, has relatively small particle diameters, and exhibits stable productivity and favorable cleaning ability, and also a method for producing the toner.

2. Description of the Related Art

Higher image quality has been demanded in the fields of copiers, printers, etc. of electrophotographic systems in recent years, and downsizing of toner particles has been vigorously investigated in order to satisfy the demand.

Conventionally, toners have been produced by milling processes in a way that a binder resin, a colorant, etc. are melted and kneaded and the kneaded product is milled and classified. However, the toners produced by the milling processes typically exhibit a broad particle diameter distribution and have a technical limit with respect to the downsizing of toner particles as well as a productive limit with respect to their yields.

Furthermore, so-called polymerization type toners have been investigated recently on the basis of toner production processes such as suspension polymerization processes and emulsion polymerization agglomeration processes. In addition, such processes referred to as polymer dissolving-suspending processes that accompany a volume shrinkage have also been investigated (Japanese Patent Application Laid-Open (JP-A) No. 07-152202). In the processes, toner materials are dispersed and dissolved into a volatile solvent such as organic solvents having lower boiling points, the solution is emulsified to produce droplets in an aqueous medium with a dispersant, then the volatile solvent is removed. The processes are excellent in that resins are widely available and polyester resins in particular, which being useful in full color processes where transparency and smoothness of fixed images are demanded, can be used in contrast to the suspension polymerization processes or emulsion polymerization agglomeration processes.

However, the polymer dissolving-suspending processes are based on the premise that a dispersant is used in an aqueous medium, therefore, there arises such a problem that the dispersant, which typically impairs charging property of toner, remains on toner surface and deteriorate environmental stability and it has also be experienced that a considerably large amount of rinsing water is necessary to remove the remaining dispersant; as such, the processes are not necessarily satisfactory.

A method to produce a toner is proposed as an alternative method for the processes described above, in which fine droplets are produced by use of piezoelectric pulse and the fine droplets are dried and solidified to produce a toner (JP-A No. 2003-262976). Furthermore, a method to produce a toner is proposed, in which fine droplets are also produced by use of thermal expansion within a nozzle and the fine droplets are dried and solidified (JP-A No. 2003-280236); furthermore, a method is proposed, in which similar procedures are carried out by use of an acoustic lens (JP-A No. 2003-262977). However, the toners resulting from these spray processes for producing particles have a truly spherical shape without irregularities at their surface.

When using toners having a truly spherical shape and smaller particle diameters, there arises a problem in cleaning ability of the toners. Blade cleaning is mainly employed in cleaning processes in current electrophotographic systems, and toners having smaller particle diameters and a spherical shape with smooth surface tend to remain on photoconductors without being scraped off by the blades to cause filming. The poor cleaning ability is one of the serious problems in the toners having smaller particle diameters produced by wet processes. It has been found that the condition to have a circularity of no more than 0.98 is necessary to assure the cleaning ability.

Japanese Patent (JP-B) No. 3166369 proposes a method in order to obtain an electrophotographic toner with irregular surface, in which spherical resin particles and inorganic fine particles are dispersed in an organic solvent, capable of swelling and non-dissolving resins, thereby to swell the resin particles and to deposit the inorganic fine particles on the surface of the resin particles, which are then spray-dried to form concave portions on their surface.

In cases of spray processes for producing particles, however, as insoluble dispersing components increase the amounts in ejecting liquids, head clogging tends to occur and also production fluctuation is likely to generate due to selectivity of ejecting components, which making difficult to assure production stability and quality stability.

BRIEF SUMMARY OF THE INVENTION

The present invention has been made in view of the circumstances described above; that is, the present invention aims to solve the problems in the art and to attain the objects described below. It is an object of the present invention to provide an electrophotographic toner that satisfies high image quality, cleaning stability, and high productivity, and a method of producing the electrophotographic toner.

The present inventors have investigated vigorously and found that the problems described above can be solved by the electrophotographic toner according to the present invention, in which the electrophotographic toner is produced by spray-drying a toner ingredient-containing liquid that dissolves or disperses at least a resin, a low molecular mass organic material, and a colorant in an organic solvent, and the resin is soluble in the organic solvent, the low molecular mass organic material is a crystalline compound or a composition of crystalline compounds that is soluble in the organic solvent, the toner ingredient-containing liquid contains substantially no particles having a particle diameter of 500 nm or more, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

That is, in accordance with the present invention, the electrophotographic toner and the method for producing the electrophotographic toner are provided as shown in the following.

That is, the inventive electrophotographic toner has specifically the technical features expressed in (1) to (6) in order to solve the problems described above.

(1) An electrophotographic toner, produced by spray-drying a toner ingredient-containing liquid, wherein the toner ingredient-containing liquid dissolves or disperses at least a resin, a low molecular mass organic material, and a colorant in an organic solvent, the resin is soluble in the organic solvent, the low molecular mass organic material is a crystalline compound or a composition of crystalline compounds that is soluble in the organic solvent, the toner ingredient-containing liquid contains substantially no particles having a particle diameter of 500 nm or more, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

(2) The electrophotographic toner according to (1), wherein water content of the toner ingredient-containing liquid is 0.3% by mass or less.

(3) The electrophotographic toner according to (1) or (2), wherein the crystalline compound or the composition of crystalline compounds has a mass average molecular mass of 100 or higher to 2000 or less.

(4) The electrophotographic toner according to any one of (1) to (3), wherein the crystalline compound or the composition of crystalline compounds has a melting temperature of 50° C. or higher.

(5) The electrophotographic toner according to any one of (1) to (4), wherein at least one of the crystalline compound and the composition of crystalline compounds has a melting temperature of 120° C. or less, and exhibits an effect to plasticize the resin through dissolving together with the resin at a temperature higher than the melting temperature.

(6) The electrophotographic toner according to any one of (1) to (5), wherein at least one of the crystalline compound and the composition of crystalline compounds performs a releasing function without dissolving together with the resin, and has a melting temperature of 100° C. or less.

The method for producing electrophotographic toner, the apparatus for forming electrophotographic image, the process cartridge, and the method for forming electrophotographic image in accordance with the present invention have specifically the technical features expressed in (7) to (17) in order to solve the problems described above.

(7) A method for producing electrophotographic toner comprising a step of periodically forming droplets, in which a toner ingredient-containing liquid is fed from a reservoir of the toner ingredient-containing liquid and periodically ejected from plural nozzles to form the droplets by way of vibrating a thin film, which being mounted at the reservoir and equipped with the plural nozzles, using a mechanical vibrating device, and a step of drying and solidifying droplets, in which the droplets of the toner ingredient-containing liquid are dried and solidified, wherein the toner ingredient-containing liquid dissolves or disperses at least a resin, a low molecular mass organic material, and a colorant in an organic solvent, the mechanical vibrating device has a vibrating face parallel to the thin film and the vibrating face longitudinally vibrates in a vertical direction, the toner ingredient-containing liquid contains substantially no particles having a particle diameter of 500 nm or more, the low molecular mass organic material is a crystalline compound or a composition of crystalline compounds, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

(8) The method for producing electrophotographic toner according to (7), wherein the mechanical vibrating device is a horn-type transducer.

(9) A method for producing electrophotographic toner comprising a step of periodically forming droplets, in which a toner ingredient-containing liquid is fed from a reservoir of the toner ingredient-containing liquid and periodically ejected from plural nozzles to form the droplets by way of vibrating a thin film, which being mounted at the reservoir and equipped with the plural nozzles, using a mechanical vibrating device, and a step of drying and solidifying droplets, in which the droplets of the toner ingredient-containing liquid are dried and solidified, wherein the toner ingredient-containing liquid dissolves or disperses at least a resin, a low molecular mass organic material, and a colorant in an organic solvent, the mechanical vibrating device is a vibration generating unit having a configuration of circular ring that is disposed around the area of the nozzles of the thin film, the toner ingredient-containing liquid contains substantially no particles having a particle diameter of 500 nm or more, the low molecular mass organic material is a crystalline compound or a composition of crystalline compounds, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

(10) The method for producing electrophotographic toner according to any one of (7) to (9), wherein vibrational frequency of the mechanical vibrating device is 20 kHz or higher to less than 2.0 MHz.

(11) A method for producing electrophotographic toner comprising an ejecting step, in which a toner ingredient-containing liquid is fed from a reservoir of the toner ingredient-containing liquid and ejected from a through pore(s) provided at the reservoir, and a droplet step, in which the toner ingredient-containing liquid, which being ejected in the ejecting step, is made into droplets through from a column-like shape to a constricted condition, and a drying and solidifying step, in which the droplets of the toner ingredient-containing liquid are dried and solidified, wherein the toner ingredient-containing liquid dissolves or disperses at least a resin, a low molecular mass organic material, and a colorant in an organic solvent, the toner ingredient-containing liquid contains substantially no particles having a particle diameter of 500 nm or more, the low molecular mass organic material is a crystalline compound or a composition of crystalline compounds, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

(12) The method for producing electrophotographic toner according to (11), wherein the through pore(s) is a nozzle head of a vibration chamber.

(13) The method for producing electrophotographic toner according to (12), wherein vibrational frequency of the nozzle head of a vibration chamber is 20 kHz or higher to less than 2.0 MHz.

(14) The method for producing electrophotographic toner according to any one of (7) to (13), wherein water content of the toner ingredient-containing liquid is 0.3% by mass or less.

(15) An apparatus for forming electrophotographic image, wherein the electrophotographic toner according to any one of (1) to (6) or the electrophotographic toner produced by the method for producing electrophotographic toner according to any one of (1) to (6) is used for the apparatus for forming electrophotographic image.

(16) An process cartridge, wherein the electrophotographic toner according to any one of (1) to (6) or the electrophotographic toner produced by the method for producing electrophotographic toner according to any one of (1) to (6) is used for the process cartridge.

(17) A method for forming electrophotographic image, wherein the electrophotographic toner according to any one of (1) to (6) or the electrophotographic toner produced by the method for producing electrophotographic toner according to any one of (1) to (6) is used for the method for forming electrophotographic image.

In accordance with the inventive electrophotographic toner, high image quality, cleaning stability, and high productivity can be satisfactorily afforded to the electrophotographic toner.

In accordance with the inventive method for producing electrophotographic toner, the method can be provided for producing the electrophotographic toner that satisfies high image quality, cleaning stability, and high productivity and also can be mono dispersed.

In accordance with the inventive apparatus for forming electrophotographic image and the inventive process cartridge, high image quality and cleaning stability can be satisfactorily afforded to the apparatus for forming electrophotographic image and the process cartridge.

DETAILED DESCRIPTION OF THE INVENTION

Figure 1:
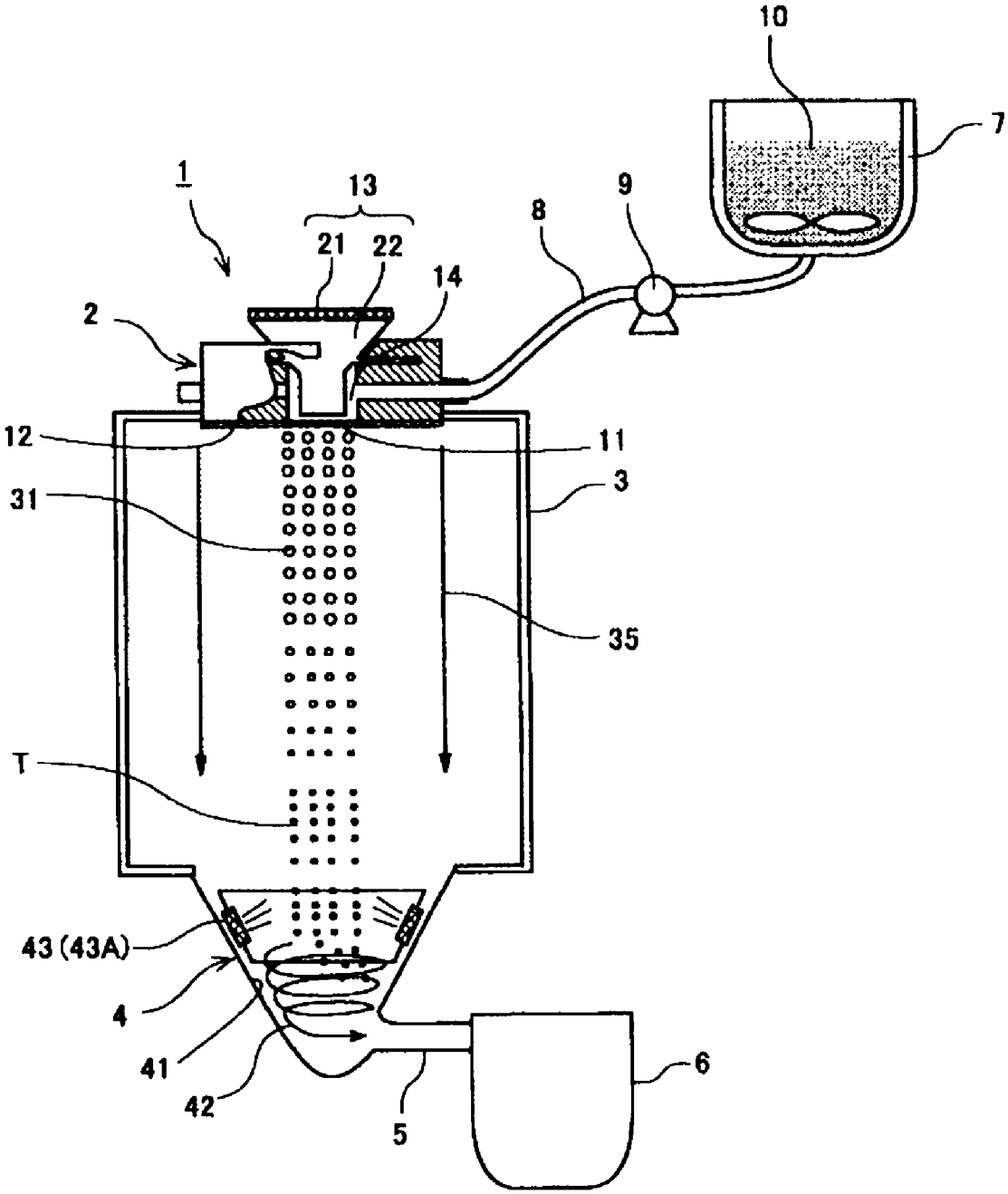
FIG. 1 is a schematic construction view that exemplarily shows a toner production apparatus to which the inventive method for producing electrophotographic toner can be applied.

The electrophotographic toner and the method for producing the electrophotographic toner according to the present invention will be explained in detail below.

Toner ingredients in the present invention are exemplified by at least a resin, a low molecular mass organic material, and a colorant, and also other optional ingredients such as external additives and charge control agents.

In the present invention, whether the resin, the low molecular mass organic material, or the other ingredients being soluble or insoluble into an organic solvent is determined in accordance with the following criteria.

The resin, the low molecular mass organic material, or the other ingredients is added and mixed for 1 hour with the intended solvent at 20° C. in an amount corresponding to 1% by mass of solid content, and the mixed liquid is further allowed to stand at 20° C. for 24 hours. After allowing to stand, the mixed liquid is visually evaluated and determined to be insoluble when an insoluble matter is confirmed at the vessel bottom. When the liquid is cloudy even though no insoluble matter is confirmed, the liquid is filled into a transparent glass cell, then haze of white light is measured at a light pass of 10 mm and defined to be soluble when the haze of white light is no more than 2.0 and to be insoluble when the haze is above 2.0.

Resin

The resin is exemplified by at least a binder resin. The binder resin may be properly selected from conventional resins without particular limitations; preferably, the content of gel components insoluble into solvents is less than 0.5% by mass. Inclusion of gel components tends to clog spray nozzles to lower production stability. When resins containing gel components are used, therefore, the resins are used after being dissolved and filtering away the gel components.

The resin used in the present invention is exemplified by vinyl polymers such as of styrene monomers, acrylic monomers, methacrylic monomers, and copolymers of two or more monomers thereof; polyester polymers, polyol resins, phenol resins, silicone resins, polyurethane resins, polyamide resins, fran resins, epoxy resins, xylene resins, terpene resins, coumarone-indene resins, polycarbonate resins, and petroleum resins.

Examples of the styrene monomers include styrene and derivatives thereof such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

Examples of the acrylic monomers include acrylic acid and esters thereof such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Examples of the methacrylic monomers include methacrylic acid and esters thereof such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

Examples of the monomer to produce the vinyl polymers or copolymers include (1) monoolefins such as ethylene, propylene, butylene, and isobutylene; (2) polyenes such as butadiene and isoprene; (3) halogenated vinyls such as vinyl chloride, vinylidene chloride, vinyl bromide, and vinyl fluoride; (4) vinyl esters such as vinyl acetate, vinyl propionate, and vinyl benzoate; (5) vinyl ethers such as vinyl methyl ether, vinyl ethyl ether, and vinyl isobutyl ether; (6) vinyl ketones such as vinyl methyl ketone, vinyl hexyl ketone, and methyl isopropenyl ketone; (7) N-vinyl compounds such as N-vinyl pyrrole, N-vinyl carbazole, N-vinyl indole, and N-vinyl pyrrolidone; (8) vinyl naphthalenes; (9) derivatives of acrylic acid or methacrylic acid such as acrylonitrile, methacrylonitrile, and acrylamide; (10) unsaturated dibasic acids such as maleic acid, citraconic acid, itaconic acid, alkenyl succinic acid, fumaric acid, and mesaconic acid; (11) unsaturated dibasic anhydrides such as maleic anhydride, citraconic anhydride, itaconic anhydride, and alkenyl succinic anhydride; (12) monoesters of unsaturated dibasic acids such as monomethyl maleate ester, monoethyl maleate ester, monobutyl maleate ester, monomethyl citraconate ester, monoethyl citraconate ester, monobutyl citraconate ester, monomethyl itaconate ester, monomethyl alkenyl succinate ester, monomethyl fumarate ester, and monomethyl mesaconate ester; (13) esters of unsaturated dibasic acids such as dimethyl maleate and dimethyl fumarate; (14) alpha-, beta-unsaturated acids such as crotonic acid and cinnamic acid; (15) alpha-, beta-unsaturated acid anhydrides such as crotonic anhydride and cinnamic anhydride; (16) anhydrides of the alpha-, beta-unsaturated acids and lower fatty acids, and monomers having a carboxyl group such as alkenylmalonic acid, alkenylglutaric acid, alkenyladipic acid, anhydrides or monoesters of these acids; (17) hydroxyalkyl esters of acrylic acid or meth acrylic acid such as 2-hydroxyethyl acrylate, 2-hydroxyethyl methacrylate, and 2-hydroxypropyl methacrylate; and (18) monomers having a hydroxyl group such as 4-(1-hydroxy-1-methylbutyl)styrene and 4-(1-hydroxy-1-methylhexyl)styrene.

In the inventive electrophotographic toner, vinyl polymers or copolymers in the binder resin may have such a cross-linked structure that is cross-linked by a cross-linking agent having two or more vinyl groups. The cross-linking agent in this purpose may be aromatic divinyl compounds such as divinyl benzene and divinyl naphthalene. Examples of diacrylate compounds, linked by an alkyl chain, include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and these compounds of which acrylate being substituted by methacrylate. Examples of diacrylate compounds, linked by an alkyl chain having an ether bond, include diethylene glycol diacrylate, triethylene glycol diacrylate, tetraethylene glycol diacrylate, polyethylene glycol 400 diacrylate, polyethylene glycol 600 diacrylate, dipolyethylene glycol diacrylate, and these compounds of which acrylate being substituted by methacrylate.

In addition, diacrylate compounds and dimethacrylate compounds are exemplified that are linked by a chain containing an aromatic group and an ether bond. Examples of polyester-type diacrylates include the compound of article name MANDA (by Nippon Kayaku Co.).

Examples of polyfunctional cross-linking agents include pentaerythritol triacrylate, trimethylolethane triacrylate, trimethylolpropane triacrylate, tetramethylolmethane tetraacrylate, oligoester acrylate, these compounds of which acrylate being substituted by methacrylate, triallyl cyanurate, and triallyl trimellitate.

The amount of these cross-linking agents is preferably 0.01 to 10 parts by mass based on 100 parts by mass of the other monomers of the vinyl polymer or copolymer, more preferably 0.03 to 5 parts by mass. Among these cross-linking monomers, preferable are aromatic divinyl compounds in particular divinyl benzene and diacrylate compounds linked by a coupling chain that contains an aromatic group and one ether bond in view of fixing ability and offset resistance of toner resin. It is preferred in particular that monomers are combined to form styrene copolymers or styrene-acrylic copolymers.

Examples of the polymerization initiator, used for the vinyl polymers or copolymers in the present invention include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane); ketone peroxides such as methylethylketone peroxide, acetylacetone peroxide, cyclohexanone peroxide; 2,2-bis(tert-butylperoxy)butane, tert-butylhydro peroxide, cumenehydro peroxide, 1,1,3,3-tetramethylbutylhydro peroxide, di-tert-butyl peroxide, tert-butylcumyl peroxide, di-cumyl peroxide, α-(tert-butylperoxy) isopropylbenzene, isobutyl peroxide, octanoyl peroxide, decanoyl peroxide, lauroyl peroxide, 3,5,5-trimethylhexanoyl peroxide, benzoyl peroxide, m-tolylperoxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl)peroxycarbonate, acetylcyclohexylsulfonyl peroxide, tert-butylperoxy acetate, tert-butylperoxy isobutylate, tert-butylperoxy-2-ethylhexylate, tert-butylperoxy laurate, tert-butyloxy benzoate, tert-butylperoxy isopropylcarbonate, di-tert-butylperoxy isophthalate, tert-butyl peroxyallylcarbonate, isoamyl peroxy-2-ethylhexanoate, di-tert-butylperoxy hexahydroterephthalate, and tert-butyl peroxyazelate.

When the binder resin is a styrene-acrylic resin, it is preferred that the resin has at least one peak in the molecular mass range of 3,000 to 50,000 (converted to number average molecular mass) and also at least one peak in the molecular mass range of no less than 100,000 in the molecular mass distribution that is measured by use of GPC for tetrahydrofuran (THF) soluble components in resin components, in view of fixing ability, offset property, and storage stability. It is also preferred, in the measurement by use of GPC for THF soluble components, that the content of components having a molecular mass of no more than 100,000 is 50% to 90% in the molecular mass distribution, more preferably, the binder resin has a main peak in the molecular mass range of 5,000 to 30,000, most preferably, the binder resin has a main peak in the molecular mass range of 5,000 to 20,000.

When the binder resin is a vinyl polymer such as styrene-acrylic resins, the acid value is preferably 0.1 to 100 mgKOH/g, more preferably 0.1 to 70 mgKOH/g, most preferably 0.1 to 50 mgKOH/g.

The monomers that constitute the polyester polymers are exemplified by those shown below.

Examples of divalent alcohol include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols prepared by polymerizing bisphenol A and cyclic ethers such as ethylene oxide and propylene oxide.

It is preferred in order to cross-link the polyester resin that an alcohol of trivalent or more is used together with.

Examples of polyvalent alcohol of trivalent or more include sorbitol, 1,2,3,6-hexanetetrol, 1,4-sorbitane, pentaerythritol such as dipentaerythritol and tripentaerythritol; 1,2,4-butanetriol, 1,2,5-pentatriol, glycerol, 2-methylpropanethiol, 2-methyl-1,2,4-butanetriol, trimethylolethane, trimethylolpropane, and 1,3,5-trihydroxybenzene.

The acid component to form the polyester polymers is exemplified by benzenedicarboxylic acids and anhydrides thereof such as phthalic acid, isophthalic acid, and terephthalic acid; alkyldicarboxylic acids and anhydrides thereof such as succinic acid, adipic acid, sebacic acid, and azelaic acid; unsaturated dibasic acids maleic acid, citraconic acid, itaconic acid, alkenylsuccinic acid, fumaric acid, and mesaconic acid; and unsaturated dibasic acid anhydrides such as maleic anhydride, citraconic anhydride, itaconic anhydride, and alkenylsuccinic anhydride. Examples of the polyvalent carboxylic acid of trivalent or more include trimellite acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, Empol trimer acid, and anhydride or partial lower alkyl esters thereof.

When the binder resin is a polyester resin, it is preferred that the resin has at least one peak in the molecular mass range of 3,000 to 50,000 in the molecular mass distribution of THF soluble components in resin components, in view of fixing ability and offset resistance; it is also preferred that the content of THF soluble components having a molecular mass of no more than 100,000 is 60% to 100% in the binder resin, and more preferably, the binder resin has at least one peak in the molecular mass range of 5,000 to 20,000.

When the binder resin is a polyester resin, the acid value is preferably 0.1 to 100 mgKOH/g, more preferably 0.1 to 70 mgKOH/g, most preferably 0.1 to 50 mgKOH/g.

The molecular mass distribution of the binder resin may be measured by gel permeation chromatography (GPC) using THF as the solvent in the present invention.

The binder resin, useful for the inventive toner, may be such resins that contains a monomer, capable of reacting with the vinyl polymer and the polyester resin, within at least one of the vinyl polymer the and polyester resin. The monomers, which constitute a component of the polyester resins and can react with the vinyl polymers, are exemplified by unsaturated dicarboxylic acid such as phthalic acid, maleic acid, and citraconic acid and anhydrides thereof. Monomers, which constitute a component of the polyester resins, are exemplified by those having a carboxylic acid or a hydroxyl group, acrylates, and methacrylates.

When the polyester polymer, the vinyl polymer, and other binder resins are used at the same time, it is preferred that the content of the resin having an acid value of 0.1 to 50 mgKOH/g as the entire binder resin is 60% by mass or more.

In the present invention, the acid value of the toner composition and the ingredients of binder resin may be determined by the following steps (I) to (IV), of which the basic procedures are pursuant to JIS K-0070.

(I) A sample is prepared in a way that additives other than binder resins (polymer components) are preliminarily removed or acid values and contents of ingredients other than binder resins and cross-linked binder resins are preliminarily obtained. When an acid value of a binder resin is measured from a toner, for example, the acid values and contents of colorants or magnetic materials are measured separately, and then the acid value of the binder resin is obtained by calculation.

(II) The sample is placed into a beaker of 300 mL, to which a mixture liquid 150 mL of toluene/ethanol (volume ratio: 4/1) is added to dissolve the sample.

(III) The solution is titrated with an ethanol solution of KOH (0.1 mol/L) using a potentiometric titration meter.

(IV) The amount of KOH solution in the titration is determined as S mL, and the blank is determined as an amount of KOH of B mL, and the acid value is calculated from Equation (1) below; in which "f" is a factor of KOH.

$$\text{acid value(mgKOH/g)}=[(S-B)\times f\times 5.61]/W. \qquad \text{Equation (1)}$$

It is preferred that the composition containing the toner binder resin and the binder resin has a glass transition temperature (Tg) of 35° C. to 80° C., more preferably 40° C. to 75° C. in view of storage stability of the toner. When the Tg is lower than 35° C., the toner tends to degrade under higher temperature atmosphere and offset may generate at fixing. On the other hand, Tg of above 80° C. may result in poor fixing ability.

Colorant

The colorant may be properly selected from conventional dyes and pigments; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrone Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and combinations thereof.

The amount of the colorant is preferably 1 to 15% by mass based on the toner, more preferably 3% to 10% by mass.

The colorant may be dispersed, in the present invention, by way of mixing and kneading at least the resin and the colorant under a high shear force, alternatively the resin and the colorant may be dispersed preliminarily in a solvent, but the present invention is not limited to these ways. High-shear dispersing devices such as three rolls are favorably employed in the mixing and kneading; beads mills are favorably employed as a dispersing device in solvents.

The particle diameter of the colorant is preferably no more than 500 nm after dispersing the colorant in the dispersing liquid. The particle diameter above 500 nm tends to clog ejecting nozzles, furthermore, the particle diameter of the colorant may increase at the stage of forming the toner, thus possibly degrading image quality and in particular decreasing optical transparency. The particle diameter is preferably no more than 300 nm. When the particle diameter of the colorant is no more than 300 nm, the optical transparency may be enhanced significantly and color reproducible range can be considerably improved. The particle size of the colorant can be measured by Laser Diffraction, Scattering, Particle Size Distribution Analyzer LA-960 (by Horiba, Ltd.).

The binder, used at dispersing step, may be, in addition to modified or unmodified polyester resins described above, polymers of styrene or its derivative substitutions such as polystyrene, poly-p-chlorostyrene and polyvinyltoluene; styrene copolymers such as styrene/p-chlorostyrene copolymer, styrene-propylene copolymer, styrene-vinyltoluene copolymer, styrene-vinylnaphthalene copolymer, styrene-methylacrylate copolymer, styrene-ethylacrylate copolymer, styrene-butylacrylate copolymer, styrene-octylacrylate copolymer, methylmethacrylate copolymer, styrene-ethylmethacrylate copolymer, styrene-butylmethacrylate copolymer, styrene-alpha-chloromethylmethacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer and styrene-maleic acid ester copolymer; polymethylmethacrylate, polybutylmethacrylate, polyvinylchloride, polyvinyl acetate, polyethylene, polypropylene, polyester, epoxy resins, epoxy polyol resins, polyurethane, polyamide, polyvinylbutyral, polyacrylic acid resins, rosin, modified rosin, terpene resins, aliphatic or cycloaliphatic hydrocarbon resins, aromatic petroleum resins, chlorinated paraffin and paraffin wax. These may be used alone or in combination.

Low Molecular Mass Organic Material

The low molecular mass organic material in the present invention is selected from such crystalline compounds that can dissolve in a content of 1% by mass or more at 30° C. within the solvent to solve the resin and can separate to crystallize when a solution dissolving the resin and the low molecular mass organic material in a ratio of 1:1 to 20:1 is coated and dried on PET, and is decided considering also the solubility with the binder resin and solvent.

The content of the crystalline compound in the electrophotographic toner may be properly selected depending on the purpose; preferably, the content is 0.5% to 40% by mass, more preferably 3% to 30% by mass.

When the content is below 0.5% by mass, irregular shape effect may be insignificant, and when the content is above 40% by mass, toner flowability may degrade. Preferably, the melting temperature of the low molecular mass organic material is no less than 50° C., more preferably no less than 60° C. The melting temperature below 50° C. may possibly degrade the toner under higher temperature atmosphere.

It is preferred in the present invention that the crystalline compound has a mass average molecular mass of 100 to 2,000, more preferably 250 to 1,000.

When the mass average molecular mass is above 2,000, the solubility may be unstable such as the solution of lower solid contents may generate recrystallization after allowing to stand the solution, and when the mass average molecular mass is below 100, there may arise such problems as heat resistance is insufficient and the crystalline compound does not crystallize within droplets at spray drying due to higher solubility with the binder resin.

The term "average molecular mass" indicates the molecular mass in cases of one species of material (crystalline compounds), the average molecular mass based on the masses of materials in cases of a mixture of plural materials (composition of crystalline compounds), and the mass average molecular mass (Mw) in cases of a material having a molecular mass distribution (crystalline compound or composition of crystalline compounds). Preferably, all of the molecular masses of crystalline compounds (mass average molecular mass (Mw) in cases of a material having a molecular mass distribution) are 100 to 2,000 in terms of those constituting the composition of crystalline compounds.

Examples of the crystalline compound are fatty esters, aromatic esters such as of phthalic acid, phosphate esters, maleic acid esters, fumaric acid esters, itaconic acid esters and other esters, benzyl compounds, benzoin compounds, ketones of benzoyl compounds, hindered phenol compounds, benzotriazole compounds, aromatic sulfonamide compounds, compounds, aliphatic amide compounds, long chain alcohols, long chain dialcohols, long chain carboxylic acids, and long chain dicarboxylic acids.

Specific examples of the crystalline compound include dimethyl fumarate, monoethyl fumarate, monobutyl fumarate, monomethyl itaconate, monobutyl itaconate, diphenyl adipate, dibenzyl terephthalate, dibenzoyl isophthalate, benzil, benzoin isopropyl ether, 4-benzoil biphenyl, 4-benzoil diphenyl ether, 2-benzoil naphthalene, dibenzoyl methane, 4-biphenyl carboxylic acid, stearyl stearic acid amide, oleyl stearic acid amide, stearic oleic acid amide, octadecanol, n-octyl alcohol, tetracosanoic acid, tetracosanoic acid, eicosanoic acid, stearic acid, lauric acid, nonadecanoic acid, palmitic acid, hydroxy octanoic acid, docosaconic acid, and the compounds of General Formulas (1) to (17) illustrated in JP-A No. 2002-105414, which being incorporated herein by reference in its entirety.

Furthermore, the crystalline compound may be natural waxes including vegetable waxes such as carnauba wax, cotton wax, wood wax, and rice wax; animal waxes such as bees wax and lanolin; mineral waxes such as ozokerite and selsyn; and petroleum wax such as paraffin, microcrystalline and petrolatum. In addition to the natural waxes, synthetic hydrocarbon waxes such as Fischer-Tropsch wax and polyethylene wax and synthetic waxes such as of esters, ketones, and ethers are exemplified. Furthermore, available are fatty acid amides such as 12-hydroxystearic acid amide, stearic acid amide, phthalic anhydride imide, and chlorinated hydrocarbon; crystalline polymer resins of low molecular mass such as homopolymers or copolymers of polyacrylates of poly-n-stearyl methacrylate or poly-n-lauryl methacrylate (e.g.

copolymer of n-stearyl acrylate-ethyl methacrylate); and crystalline polymers having a long alkyl group in a side chain. These may be used alone or in combination of two or more.

These crystalline compounds may perform as follows depending on the combined resins.

When the resin and the crystalline compound dissolve together with at temperatures higher than the melting temperature of the crystalline compound, the crystalline compound performs as a plasticizer; that is, the softening velocity of the resin increases by virtue of the crystalline compound, low temperature fixability may be derived. In such cases, the melting temperature of the crystalline compound is preferably no higher than 120° C., more preferably no higher than 120° C. When the melting temperature is preferably higher than 120° C., the effect of the low temperature fixability may be less.

When the resin and the crystalline compound do not dissolve together with at temperatures higher than the melting temperature of the crystalline compound, the crystalline compound performs as a releasing agent. In such cases, the melting temperature of the crystalline compound with releasing ability (hereinafter referred to also as "releasable crystalline compound") is preferably no higher than 100° C., more preferably no higher than 100° C. In cases where the melting temperature is higher than 100° C., cold offset is likely to occur at fixing steps.

As regards the melt viscosity of the releasable crystalline compound, the viscosity, measured at 20° C. higher than the melting temperature of the releasable crystalline compound, is preferably 5 to 1,000 cps, more preferably 10 to 100 cps.

When the melt viscosity is less than 5 cps, the releasing ability may be poor, and when above 1,000 cps, the effects on hot offset resistance and the low temperature fixability may be less.

It is necessary in the inventive electrophotographic toner that at least one low molecular mass organic material is soluble in the solvent, and thus low molecular mass organic materials, which are insoluble in a solvent similar as the low molecular mass organic material, may be used as dispersion.

Organic Solvent

The organic solvent in the present invention is one capable of dissolving the binder resin and the low molecular mass organic material, and is properly selected depending on the solubility of the binder resin and the low molecular mass organic material.

Specific examples of the solvent in the present invention include water; alcohols such as methanol, ethanol, isopropanol, n-butanol, methylisocarbinol; ketones such as acetone, 2-butanone, ethyl amyl ketone, diacetone alcohol, isophorone, and cyclohexanone; amides such as N,N-dimethyl formamide and N,N-dimethyl acetamide; ethers such as diethyl ether, isopropyl ether, tetrahydrofuran, 1,4-dioxane, and 3,4-dihydro-2H-pyran; glycol ethers such as 2-methoxy ethanol, 2-ethoxy ethanol, 2-butoxy ethanol, ethylene glycol and dimethyl ether; glycol ether acetates such as 2-methoxy ethyl acetate, 2-ethoxy ethyl acetate, and 2-butoxy ethyl acetate; esters such as methyl acetate, ethyl acetate, isobutyl acetate, amyl acetate, ethyl lactate, and ethylene carbonate; aromatic hydrocarbons such as benzene, toluene, and xylene; aliphatic hydrocarbons such as hexane, heptane, iso-octane, and cyclohexane; halogenated hydrocarbons such as methylene chloride, 1,2-dichloro ethane, dichloro propane, and chloro benzene; sulfoxides such as dimethyl sulfoxide; pyrrolidones such as N-methyl-2-pyrrolidone and N-octyl-2-pyrrolidone. These may be used alone or in combination of two or more.

The organic solvent in the present invention dissolves or disperses the toner ingredients and the other materials as required. It is preferred that the toner ingredient-containing liquid contains no particles having a particle diameter of no more than 500 nm, more preferably no particles having a particle diameter of no more than 300 nm, still more preferably no particles having a particle diameter of no more than 200 nm.

Other Materials

In addition to the resin, the low molecular mass organic material, and the colorant described above, other materials such as inorganic fine particles, flow improvers, cleaning aids, charge control agents, etc. may be used as an external additive in order to provide the toner particle with flowability, developing ability, charging ability, etc.

The inorganic fine particle may be properly selected depending on the application; examples thereof include silica, alumina, titanium oxide, barium titanate, magnesium titanate, calcium titanate, strontium titanate, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide, silicon nitride, and the like. These may be used alone or in combination of two or more.

The primary particle diameter of the inorganic fine particles is preferably 5 nm to 2 μm, more preferably 5 to 500 nm. The specific surface area of the inorganic fine particle is preferably 20 to 500 $m^2/g$ measured by BET method.

The content of the inorganic fine particle is preferably 0.01% to 5.0% by mass in the electrophotographic toner, more preferably 0.01% to 2.0% by mass.

The flow improver means an agent to make possible to prevented from deterioration of flowability or charging ability even under high humidity conditions by improving the hydrophobicity thereof using a surface treatment agent; examples thereof include silane coupling agents, sililation reagents, silane coupling agents having a fluorinated alkyl group, organic titanate coupling agents, aluminum coupling agents, silicone oils, and modified silicone oils. It is preferable in particular that the silica and the titanium oxide are surface-treated by these flow improvers and used as hydrophobic silica and hydrophobic titanium oxide.

The cleaning aid may be added to the inventive toner in order to remove toners remaining after transferring on photoconductors or primary transfer media; the cleaning aid is exemplified by fatty acid metal slats such as zinc stearate, calcium stearate, and stearic acid; and polymer fine particles produced by a soap-free emulsion polymerization such as polymethyl methacrylate fine particles and polystyrene fine particles. The polymer fine particles preferably have a relatively narrow particle size distribution and a volume average particle diameter of 0.01 to 1 μm.

The charge control agent may be properly selected from conventional ones; examples thereof include nigrosine dyes, triphenylmethane dyes, chromium-containing metal complex dyes, molybdic acid chelate pigments, rhodamine dyes, alkoxy amines, quaternary ammonium salts such as fluoride-modified quaternary ammonium salts, alkylamides, elemental phosphorus or compounds thereof, elemental tungsten or compounds thereof, fluoride activators, metallic salts of salicylic acid, and metallic salts of salicylic acid derivatives. These may be used alone or in combination of two or more.

The charge control agent may be commercially available ones; examples thereof include Bontron 03 of nigrosine dye, Bontron P-51 of quaternary ammonium salt, Bontron S-34 of metal-containing azo dye, Bontron E-82 of oxynaphthoic acid metal complex, Bontron E-84 of salicylic acid metal complex, and Bontron E-89 of phenol condensate (by Orient Chemical Industries, Ltd.); TP-302 and TP-415 of quaternary ammonium salt molybdenum metal complex (by Hodogaya Chemical Co.); Copy Charge PSY VP2038 of quaternary ammonium salt, Copy Blue PR of triphenylmethane derivative, and Copy Charge NEG VP2036 and Copy Charge NX VP434 of quaternary ammonium salt (by Hoechst Ltd.); LRA-901, and LR-147 of boron metal complex (by Japan Carlit Co., Ltd.), copper phthalocyanine, perylene, quinacridone, azo pigment, and other high-molecular weight compounds having a functional group, such as sulfonic acid group, carboxyl group, and quaternary ammonium salt.

The content of the charge control agent in the toner is not defined specifically and depends on species of the resins, existence or nonexistence of the additives, dispersing processes, etc.; preferably, the content is 0.1 to 10 parts by mass based on the binder resin, more preferably 0.2 to 5 parts by mass. When the content is below 0.1 part by mass, the charge control effect may be insignificant, and when the content is above 10 parts by mass, the charging ability of the toner is excessively large, which possibly decreasing the effect of the charge control agent, and lowering flowability of developers or reducing image density due to higher electrostatic attraction with developing rollers.

Toner Production Method

In the first embodiment of the method for producing electrophotographic toner according to the present invention, the method comprises a step of periodically forming droplets, in which a toner ingredient-containing liquid is fed from a reservoir of the toner ingredient-containing liquid and periodically ejected from plural nozzles to form the droplets by way of vibrating a thin film, which being mounted at the reservoir and equipped with the plural nozzles, using a mechanical vibrating device, and a step of drying and solidifying droplets, in which the droplets of the toner ingredient-containing liquid are dried and solidified, wherein the toner ingredient-containing liquid dissolves or disperses at least a resin, a low molecular mass organic material, and a colorant in an organic solvent, the mechanical vibrating device has a vibrating face parallel to the thin film and the vibrating face longitudinally vibrates in a vertical direction, the toner ingredient-containing liquid contains substantially no particles having a particle diameter of 500 nm or more, the low molecular mass organic material is a crystalline compound or a composition of crystalline compounds, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

In the second embodiment of the method for producing electrophotographic toner according to the present invention, the method comprises a step of periodically forming droplets, in which a toner ingredient-containing liquid is fed from a reservoir of the toner ingredient-containing liquid and periodically ejected from plural nozzles to form the droplets by way of vibrating a thin film, which being mounted at the reservoir and equipped with the plural nozzles, using a mechanical vibrating device, and a step of drying and solidifying droplets, in which the droplets of the toner ingredient-containing liquid are dried and solidified, wherein the toner ingredient-containing liquid dissolves or disperses at least a resin, a low molecular mass organic material, and a colorant in an organic solvent, the mechanical vibrating device is a vibration generating unit having a configuration of circular ring that is disposed around the area of the nozzles of the thin film, the toner ingredient-containing liquid contains substantially no particles having a particle diameter of 500 nm or more, the low molecular mass organic material is a crystalline compound or a composition of crystalline compounds, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

Furthermore, in the third embodiment of the method for producing electrophotographic toner according to the present invention, the method comprises an ejecting step, in which a toner ingredient-containing liquid is fed from a reservoir of the toner ingredient-containing liquid and ejected from a through pore(s) provided at the reservoir, and a droplet step, in which the toner ingredient-containing liquid, which being ejected in the ejecting step, is made into droplets through from a column-like shape to a constricted condition, and a drying and solidifying step, in which the droplets of the toner ingredient-containing liquid are dried and solidified, wherein the toner ingredient-containing liquid dissolves or disperses at least a resin, a low molecular mass organic material, and a colorant in an organic solvent, the toner ingredient-containing liquid contains substantially no particles having a particle diameter of 500 nm or more, the low molecular mass organic material is a crystalline compound or a composition of crystalline compounds, the crystalline compound or the composition of crystalline compounds crystallizes upon spray-drying to deform toner particles into a circularity of 0.93 or higher to 0.98 or less, and volume average particle diameter of the toner particles is 3.0 μm or higher to less than 7.0 μm.

In order to exclude the particles having a particle diameter of 500 nm or more from the toner ingredient-containing liquid, a filtering step is preferably provided. In the filtering step, the toner ingredients may be filtered or the toner ingredient-containing liquid may be filtered. That is, the toner ingredients may be filtered to remove the particles having a particle diameter of 500 nm or more and dissolved or dispersed in the organic solvent to obtain the toner ingredient-containing liquid, or the toner ingredient-containing liquid may be filtered to remove the particles having a particle diameter of 500 nm or more; or these two filtering steps may be combined. In this relation, when the toner ingredients are filtered in the filtering step, all of the toner ingredients are not necessarily required to filter, thus only the ingredients containing insoluble elements may be filtered, for example.

A decreasing drying step, a classifying step, and a mixing step are provided as required after the drying and solidifying step.

The apparatus for producing the inventive electrophotographic toner may be properly selected from those suited to produce electrophotographic toners through a spray-drying process; that is, the apparatus performs as a toner producing apparatus that is equipped with a droplet forming unit that ejects the toner ingredient-containing liquid containing at least the resin, the low molecular mass organic material, and the colorant from a nozzle(s) to produce droplets and a solvent removing unit to dry the droplets.

As regards the droplet forming unit, mono-fluid nozzles (pressure nozzles) in which a liquid is pressurized and sprayed, multi-spray nozzles in which a liquid and a compressed gas are mixed and sprayed, and rotating disc sprayers in which a liquid is made into droplets by action of centrifugal force using a rotating disc are publicly known. These nozzles or devices may be useful, however, are deficient in that toners with smaller particle sizes are difficult to produce and particle distribution of the resulting toners is broad to require classification, thus the process yield is decreased and the productivity is lowered.

The present inventors have found a periodic method to produce droplets, which improves the deficiencies described above, in which the toner ingredient-containing liquid is periodically ejected from a thin film having nozzles with a certain diameter using a mechanical vibrating device, thereby to produce a toner with a uniform particle size.

In accordance with the periodic method to produce droplets in the inventive method for producing electrophotographic toner, droplets may be produced with a uniform particle diameter by way of mechanically vibrating a thin film having plural nozzles thereby to eject the toner ingredient-containing liquid continuously from the nozzles. The mechanical vibrating device may be properly disposed as long as capable of vibrating vertically the thin film with the nozzles, preferably, the two ways are employed in the present invention.

One way is a mechanical vibrating device that has a vibrating face parallel to the thin film with the plural nozzles and the vibrating face longitudinally vibrates in a vertical direction (mechanical longitudinal vibrating device), and another way is a mechanical vibrating device that has a configuration of circular ring and is disposed around the thin film with the nozzles (circular ring-like mechanical vibrating device). These ways are explained in the following.

Mechanical Longitudinal Vibrating Device

First Embodiment

A toner production apparatus, equipped with a mechanical longitudinal vibrating device, will be explained exemplarily with reference to the schematic construction view of FIG. 1.

The toner production apparatus 1 is equipped with a droplet ejection unit 2 to eject the toner ingredient-containing liquid that contains at least the resin and the colorant, a particle forming portion 3 in which droplets of the toner ingredient-containing liquid ejected from the droplet ejection unit 2 are solidified to form toner particles T (drying/solidifying unit, drying/solidifying) and the droplet ejection unit 2 is disposed above the particle forming portion 3, a toner collecting portion 4 to collect the toner particles T formed at the particle forming portion 3, a toner storage portion 6 to store the toner particles T that are collected at the toner collecting portion 4 and conveyed through a tube 5, a raw material containing portion 7 to contain the toner ingredient-containing liquid 10, a pipe 8 (feed pipe) to feed the toner ingredient-containing liquid 10 from the raw material containing portion 7 to the droplet ejection unit 2, and a pump 9 to pressurize to feed the toner ingredient-containing liquid 10 at starting operation, etc.

The toner ingredient-containing liquid 10, from the raw material containing portion 7, is fed spontaneously to the droplet ejection unit 2 by action of producing droplets at the droplet ejection unit 2, and is fed secondarily by the pump 9 at starting operation. The toner ingredient-containing liquid 10 is a solution or dispersion that dissolves or disperses, in an organic solvent, the toner ingredients comprising a resin, a colorant, a crystalline compound or a composition of crystalline compounds that is soluble in the organic solvent.

The droplet ejection unit 2 will be explained with reference to FIGS. 2 and 3.

Figure 2:
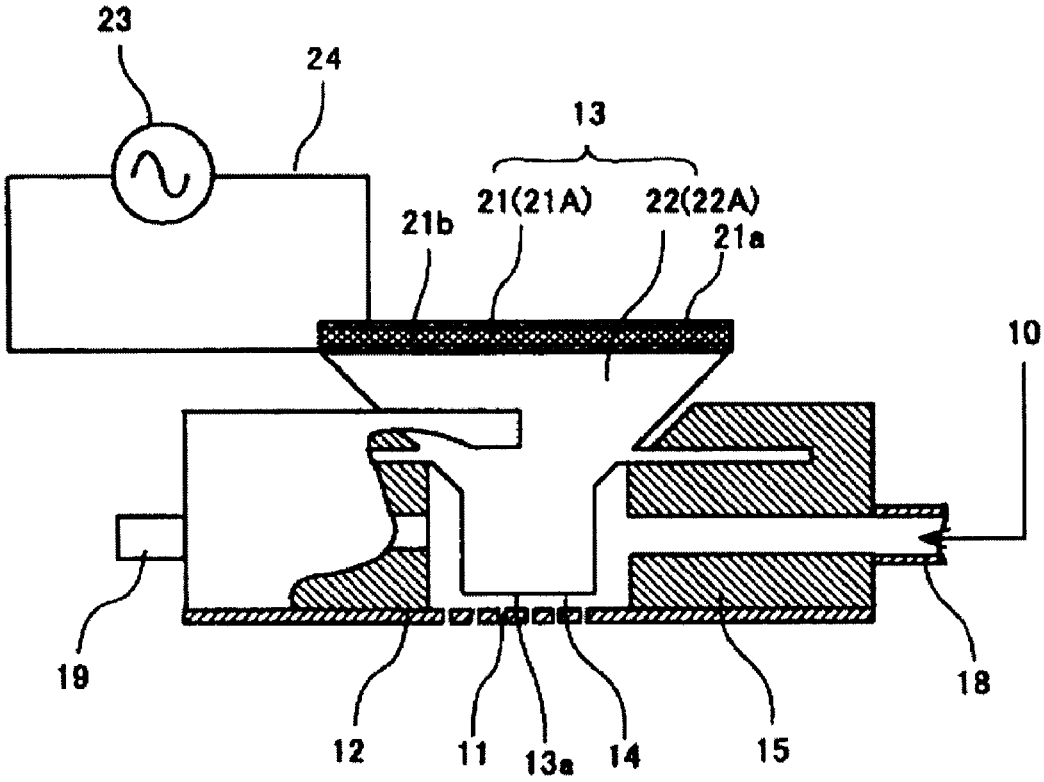
FIG. 2 is an enlarged view that illustrates a droplet ejection unit of the toner production apparatus.
Figure 3:
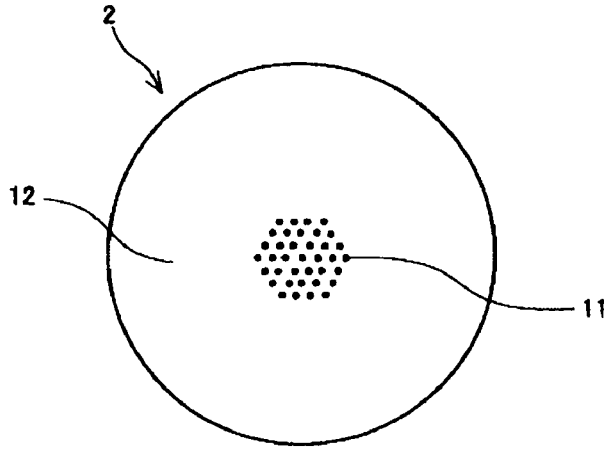
FIG. 3 is a view that illustrates the bottom portion of FIG. 2 viewed from downside.

FIG. 2 is a schematic cross-sectional view that illustrates the droplet ejection unit 2, and FIG. 3 is a view schematically showing the bottom portion of the droplet ejection unit 2 that corresponds to FIG. 2 viewed from downside.

The droplet ejection unit 2 is equipped with a thin film 12 to which plural nozzles 11 (discharging holes) being provided, a mechanical longitudinal vibrating device 13 (hereinafter referred to as "vibrating device" to vibrate the thin film 12, a flow path member 15 to form a liquid channel 14 for supplying the toner ingredient-containing liquid 10, containing at least a resin and a colorant, between the thin film 12 and the vibrating device 13.

The thin film 12 with the plural nozzles 11 is disposed in parallel to the vibrating face 13*a* of the vibrating device 13, a part of the thin film 12 is fixed to the flow path member 15 using a solder or an adhesive that is insoluble in the toner ingredient-containing liquid, and the thin film 12 is disposed substantially perpendicular to the vibrating direction of the vibrating device 13. A communication device 24 is provided to apply a voltage signal to upper/lower sides of the vibration generating device 21 of the vibrating device 13, thereby the signal from a driving signal generating source 23 can be converted to a mechanical vibration. A lead wire with an insulative coating is adapted to the communication device to transmit electric signals. As regards the vibrating device 13, elements with larger vibration amplitudes such as various horn-type transducers and bolt-clamped Langevin transducers are preferable in view of effective and stable production of toners.

The vibrating device 13 is constructed from a vibration generating device 21 to generate vibration and a vibration amplifying device 22 to amplify the vibration generated by the vibration generating device 21, and the thin film 12 is vibrated at an intended frequency by action of periodical pressure due to vibration of the vibrating face 13 by way of applying a driving voltage (driving signal) of the intended frequency from a driving circuit 23 (driving signal generating source) between electrodes 21*a* and 21*b*, exciting a vibration on the vibration generating device 21, amplifying the vibration by the vibration amplifying device 22, and vibrating periodically the vibrating face 13*a* in parallel with the thin film 12.

The vibrating device 13 may be properly selected, without particular limitations, from those capable of generating certain longitudinal vibration to the thin film 12; preferably, the vibration generating device 21 is a dimorph-type piezoelectric body 21A to excite a flexural vibration since the thin film 12 is to be vibrated. The piezoelectric body 21A performs to transfer an electric energy into a mechanical energy; specifically, application of a voltage can excite a flexural vibration to vibrate the thin film 12.

The piezoelectric body 21A of the vibration generating device 21 may be piezoelectric ceramics such as lead zirconium titanate (PZT). The piezoelectric ceramics typically exhibit a small displacement magnitude, thus are laminated in use. The other piezoelectric materials are exemplified by piezoelectric polymers such as polyvinylidene fluoride (PVDF) and single crystals such as of quartz, $LiNbO_3$, $LiTaO_3$, and $KNbO_3$.

The vibrating device 13 may be optionally disposed as long as capable of vertically vibrating the thin film 12 with nozzles 11, and the vibrating face 13*a* is disposed in parallel to the thin film 12.

FIG. 2 exemplarily shows a horn-type transducer of the vibrating device 13 that is constructed from a vibration generating device 21 and a vibration amplifying device 22. In such horn-type transducers, the amplitude of the vibration generating device 21 such as of piezoelectric devices can be amplified by the horn 22A of the vibration amplifying device 22; thus the vibration of the vibration generating device 21 itself is allowed to be of a low level to generate the mechanical vibration, which leading to longer operating life of production apparatuses by virtue of lower mechanical load.

Figure 4:
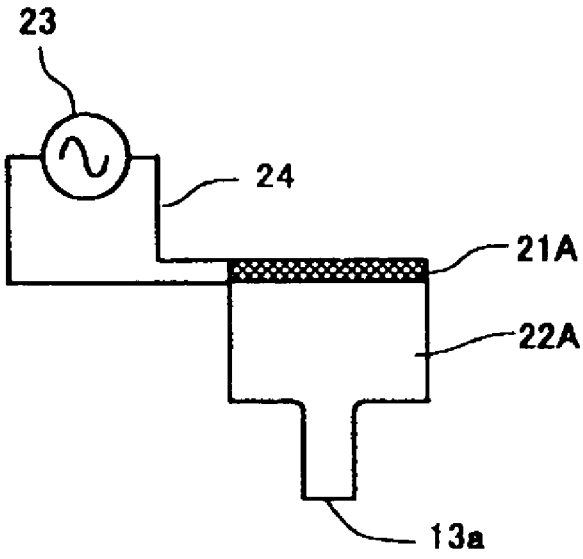
FIG. 4 is a schematic view that exemplarily shows a step-type horn-type transducer that constructs a vibration generating device of the droplet ejection unit.
Figure 5:
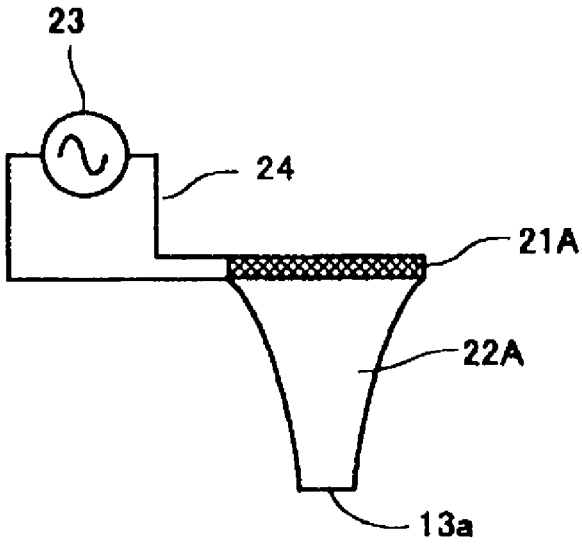
FIG. 5 is a schematic view that exemplarily shows an exponential-type horn-type transducer that constructs a vibration generating device of the droplet ejection unit.
Figure 6:
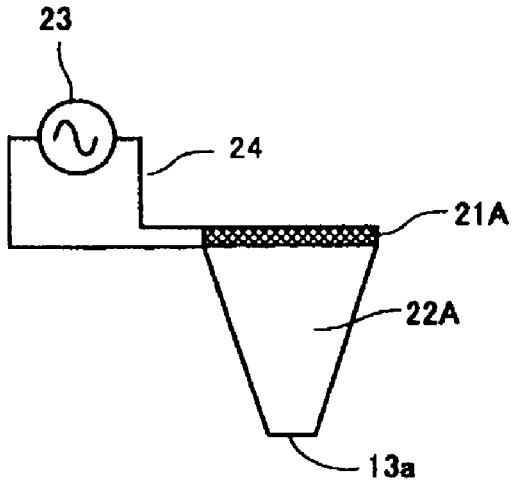
FIG. 6 is a schematic view that exemplarily shows a conical-type horn-type transducer that constructs a vibration generating device of the droplet ejection unit.

The horn-type transducer may be of conventional typical horn-type such as step-type as shown in FIG. 4, exponential-type as shown in FIG. 5, and conical-type as shown in FIG. 6. In these horn-type transducers, the vibrating face 13*a* is designed as the surface of the largest vibration by way that the piezoelectric body 21A is disposed at the larger side of the horn 22A, the piezoelectric body 21A induces effective vibration of the horn 22A by use of longitudinal vibration, and the smaller side of the horn 22A is used as the vibrating face. Lead wires 24, disposed above and below the piezoelectric body 21A, transmit AC voltage signals from the driving circuit 23. The shape of the horn-type transducers is designed to provide the side 13*a* with the largest vibration.

The vibrating device 13 may be bolt-clamped Langevin transducers with especially high strength. The bolt-clamped Langevin transducers are mechanically attached with a piezoelectric ceramic thus are free from breakage at exciting large amplitude.

The configuration of the reservoir, the mechanical vibrating device, and the thin film will be explained in detail with reference to the schematic view of FIG. 2. At least one liquid supplying tube 18 is provided at the reservoir 14, and a liquid is introduced into the reservoir through a flow path as shown the partial cross-sectional view. A bubble releasing tube 19 may be provided as required. A droplet ejection unit 2 is disposed and supported at the upper side of the particle forming portion 3 by a support (not shown) attached to the flow path member 15. The arrangement of the droplet ejection unit 2 attached to the upper side of the particle forming portion 3 is explained herein; on the other hand, the droplet ejection unit 2 may be attached to side wall or bottom of the drying portion of the particle forming portion 3.

The size of the vibrating device 13 to generate the mechanical vibration typically increases along with decreasing the oscillating frequency, and the reservoir may be appropriately provided by way of directly piercing the vibrating unit depending on the required frequency. The entire reservoir may also be effectively vibrated. In these cases, the vibrating face is defined in the present invention as the face to which the thin film with the plural nozzles is laminated.

Another example of the droplet ejection unit 2 having a similar configuration will be explained with reference to FIGS. 7 and 8.

Figure 7:
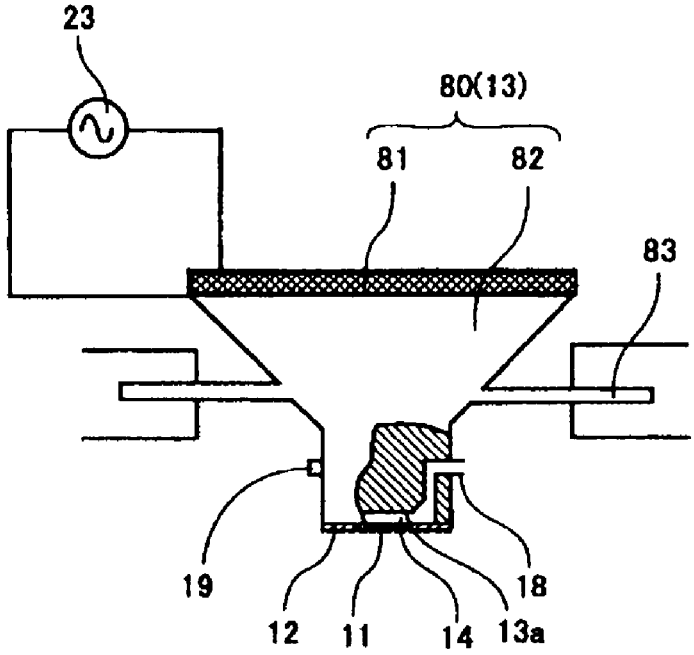
FIG. 7 is an enlarged view that illustrates another example of the droplet ejection unit of the toner production apparatus.

In the example shown in FIG. 7, a reservoir 14 (flow path) is formed at a part of a horn 82 by use of a horn-type transducer 80 as a vibrating device 80 (13), which is constructed from a piezoelectric body 81 as a vibration generating portion and a horn 82 as a vibration amplifying portion. It is preferred that the droplet ejection unit 2 is fixed to a wall side of the particle forming portion 3 (drying/solidifying device) by a fixing portion 83 (flange portion) integrated with the horn 82 of the horn-type transducer 80, and the fixing may be carried out using an elastic body (not shown) to prevent loss of the vibration.

Figure 8:
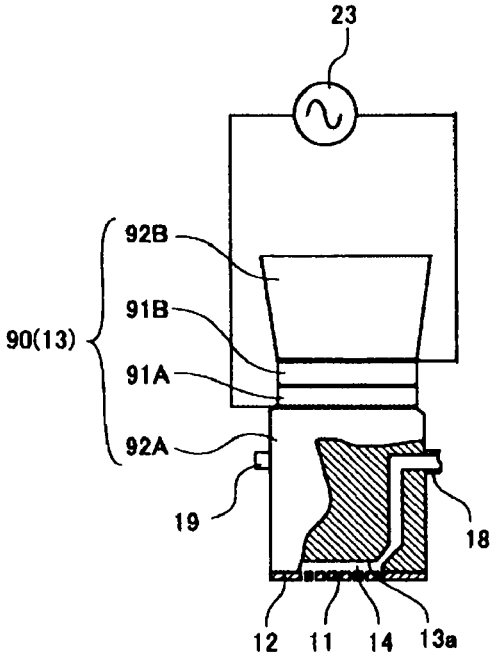
FIG. 8 is an enlarged view that illustrates still another example of the droplet ejection unit of the toner production apparatus.

In the example shown in FIG. 8, a reservoir (flow path 14) is formed at a horn 92A by use of a bolt-clamped Langevin transducer 92 as a vibrating device 90 (13), which is constructed by firmly mechanically fixing piezoelectric bodies 91A, 91B as a vibration generating portion and horns 92A, 92B. These devices may be enlarged depending on the frequency condition, and the thin film with the plural nozzles may be laminated by way of processing a fluid inlet/outlet and a reservoir in the transducer as shown FIG. 8.

FIG. 1 shows an example where only one droplet ejection unit 2 is attached to the particle forming portion 3; in this connection, plural droplet ejection units 2 are preferably disposed in parallel at upper side of the particle forming portion 3 (drying tower) in view of higher productivity, preferably, the number of the droplet ejection units is 100 to 1000 in view of controllability. In such cases, the reservoirs 14 of the droplet ejection units 2 are constructed to connect to a raw material containing portion 7 (common reservoir) through a pipe 8 to supply the toner ingredient-containing liquid 10. The toner ingredient-containing liquid 10 may be supplied along with forming the droplets and may be supplied secondarily by a pump 9 at starting operations.

Figure 9:
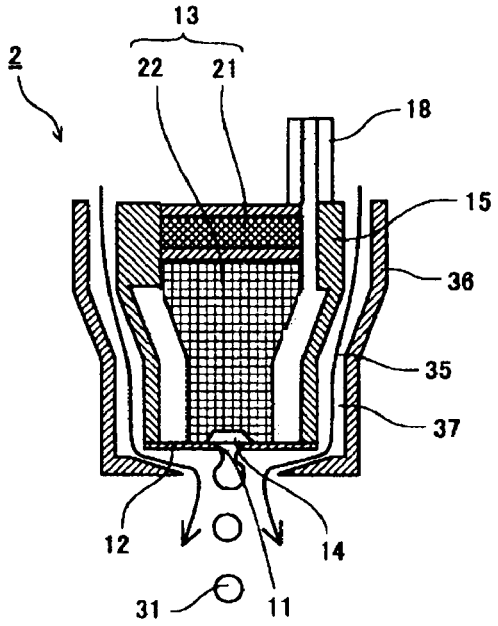
FIG. 9 is an enlarged view that illustrates still another example of the droplet ejection unit of the toner production apparatus.

Another example of the droplet ejection unit will be explained with reference to FIG. 9 that is a schematic cross-sectional view to illustrate the droplet ejection unit.

In the droplet ejection unit 2, a horn-type transducer is employed as the vibrating device 13 similarly as the example described above, a flow path member 15 to supply the toner ingredient-containing liquid 10 is disposed around the vibrating generating device 13, and a reservoir 14 is formed at the portion of the horn 22, where facing the thin film 12, of the vibrating generating device 13. Gas flow forming portions 36 are also disposed that form a gas path 37 to flow a gas 35, with a certain distance around the flow path member 15. The nozzles 11 of the thin film 12 are shown one for simplifying the figure, but the number is plural as described above.

Figure 10:
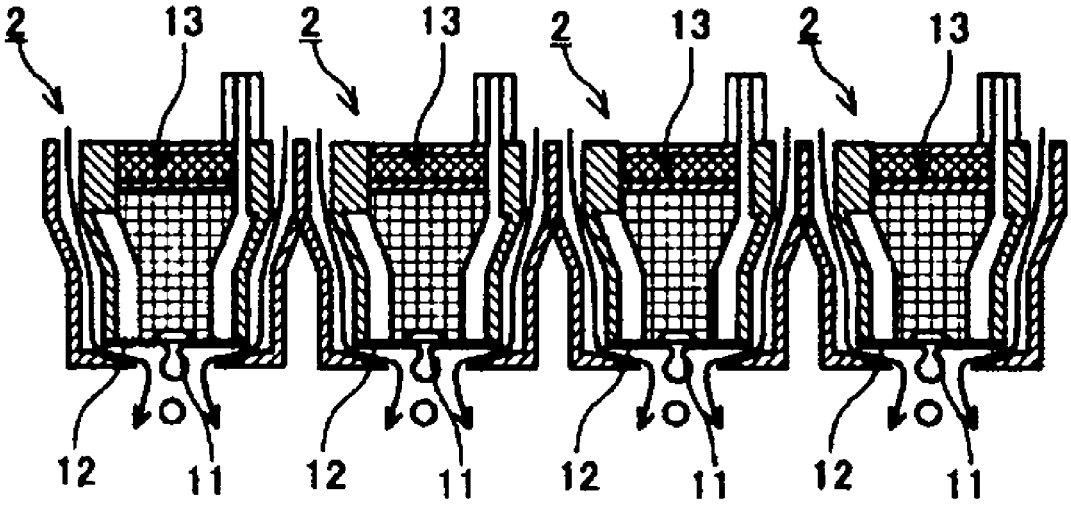
FIG. 10 is an illustrative view that exemplarily explains the arrangement of plural droplet ejection units shown in FIG. 9.

As shown in FIG. 10, plural number, for example, 100 to 1000 of the droplet ejection units 2 in view of controllability are aligned and disposed at the drying tower reservoir 3A of the particle forming portion 3, thereby the productivity may be enhanced still more.

Circular Ring-like Mechanical Vibrating Device

Second Embodiment

Figure 11:
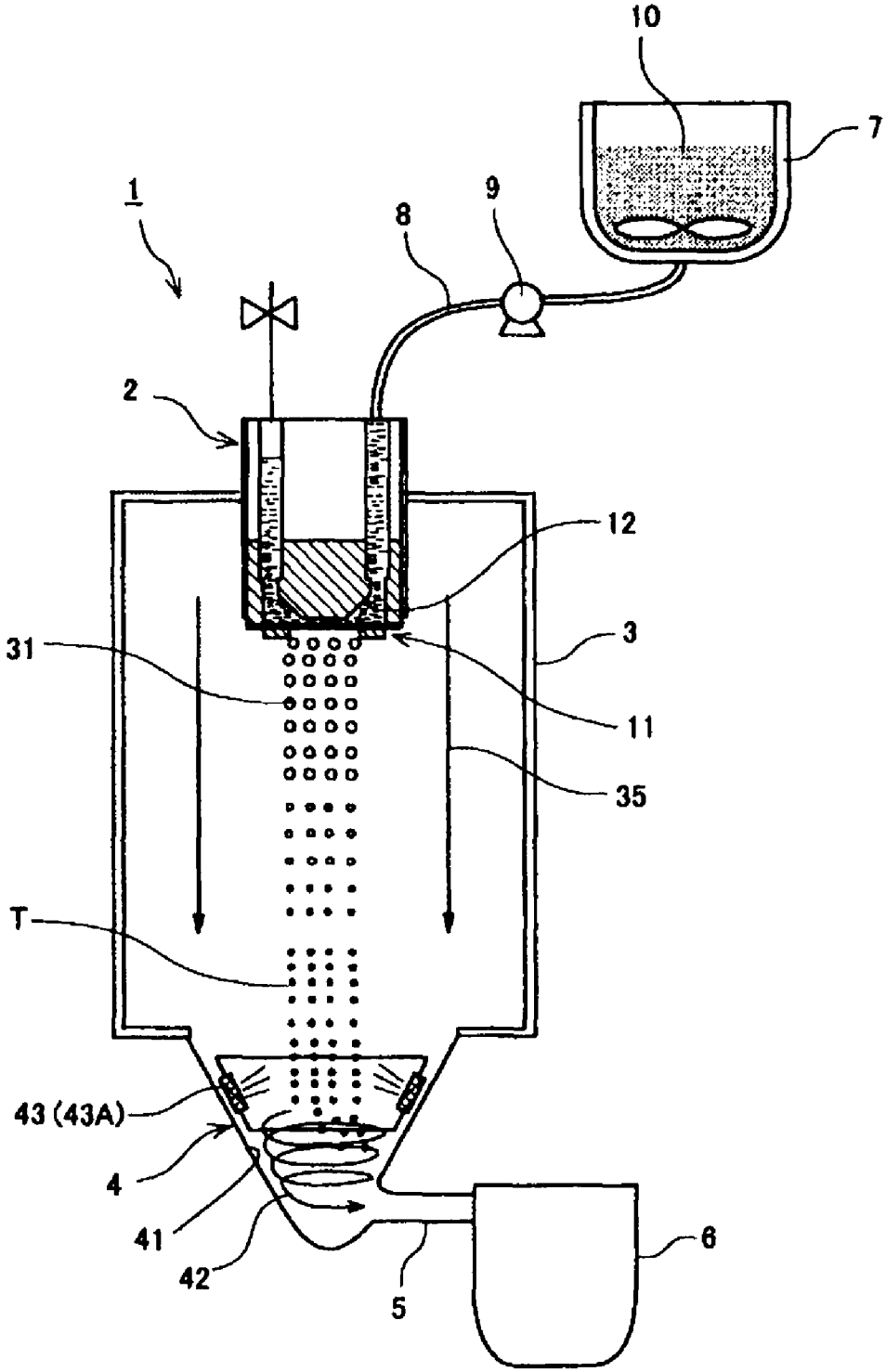
FIG. 11 is a schematic construction view that shows an embodiment of a toner production apparatus to which the inventive method for producing electrophotographic toner can be applied.

FIG. 11 shows a toner production apparatus similar as that of FIG. 1 except that the droplet ejection unit is exchanged into a ring type.

Figure 12:
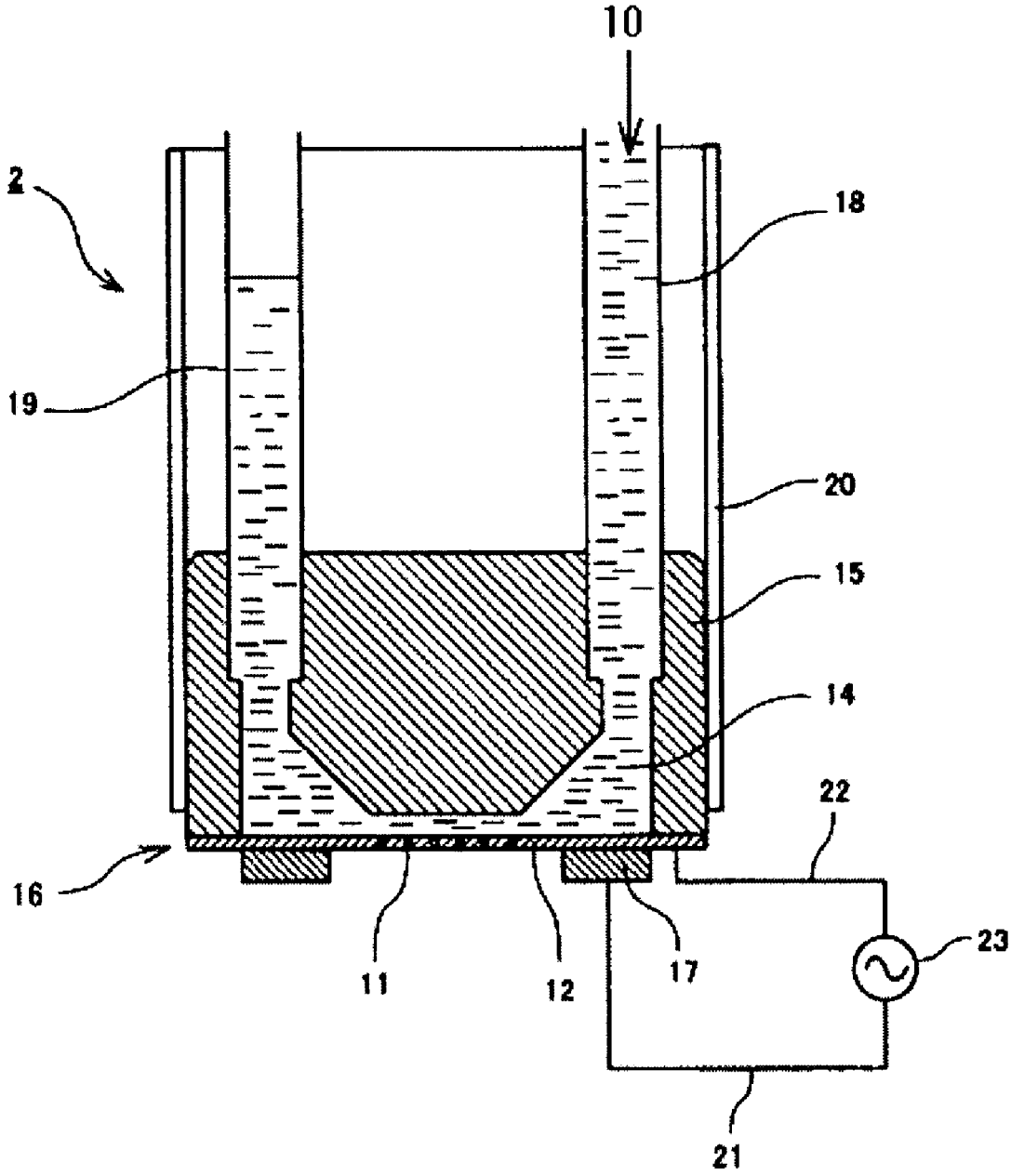
FIG. 12 is an enlarged view that illustrates a droplet ejection unit of the toner production apparatus.
Figure 13:
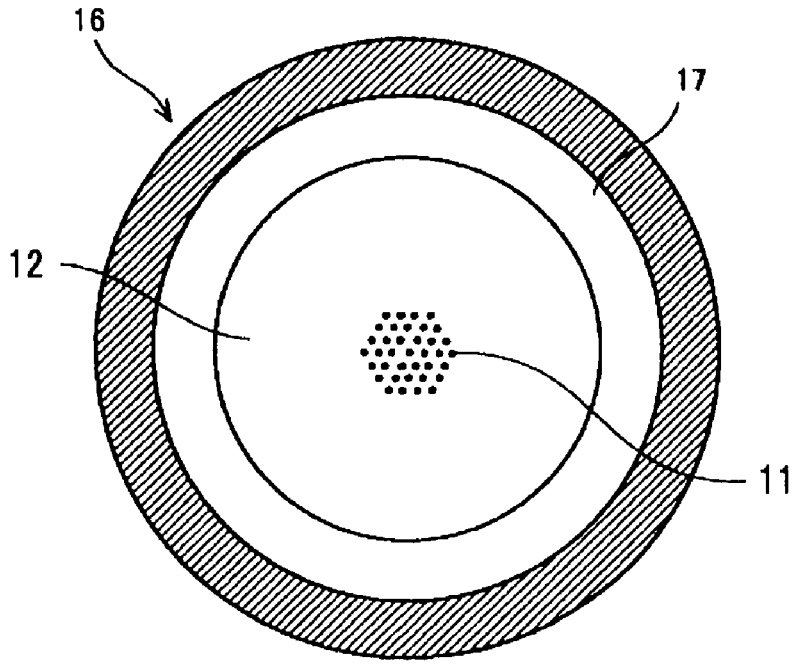
FIG. 13 is a view that illustrates the bottom portion of FIG. 12 viewed from downside.
Figure 14:
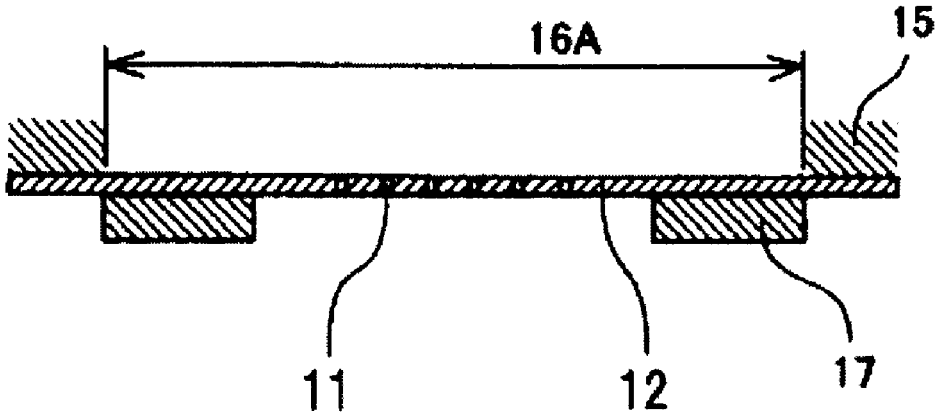
FIG. 14 is an enlarged cross-sectional view that illustrates a droplet forming device of the droplet ejection unit.

The droplet ejection unit 2 of ring type will be explained with reference to FIGS. 12 to 14. FIG. 12 is a cross-sectional view that illustrates the droplet ejection unit 2; FIG. 13 is a view schematically showing the bottom portion of the droplet ejection unit 2 that corresponds to FIG. 12 viewed from downside; and FIG. 14 is a schematic cross-sectional view that illustrates the droplet forming device.

The droplet ejection unit 2 is equipped with the droplet forming device 11 that makes the toner ingredient-containing liquid 10, containing at least the resin and the colorant, into droplets and ejects them and the flow path member 15 to which a reservoir 14 (liquid flow path) is formed for supplying the toner ingredient-containing liquid 10 into the droplet forming device 11.

The droplet forming device 16 is constructed from the thin film 12, to which plural nozzles 11 (discharging outlet) being formed, and a circular ring-like vibration generating device 17 (circular ring-like mechanical vibrating device, electromechanical transducer) to vibrate the thin film 12. The peripheral portion of the thin film 12 (slashed region in FIG. 14) is attached and fixed to the flow path member 15 using a solder or an adhesive that is insoluble in the toner ingredient-containing liquid. The vibration generating device 17 is disposed around the deformable region 16A (region unfixed to flow path member 15) of the thin film 12. When a driving voltage (driving signal) of a required frequency is applied to the vibration generating device 17 from a driving circuit 23 (source of driving signal) through lead wires 21, 22, for example, a flexural vibration generates.

Figure 15:
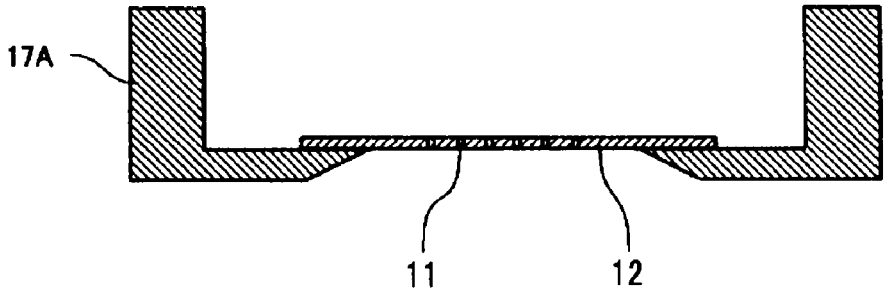
FIG. 15 is an enlarged cross-sectional view that illustrates a droplet forming device of a construction of Comparative Example.

When the circular ring-like vibration generating device 17 is disposed around the deformable region 16A of the thin film 12 with the plural nozzles adjacent to the reservoir 14, the displacement magnitude of the thin film 12 is relatively large, in the droplet forming device 16, compared to the configuration in which the vibration generating device 17A holds the periphery of the thin film 12 as the comparative configuration shown in FIG. 15 for example; therefore, plural nozzles 11 can be disposed at the region of larger area (ϕ: 1 mm or more) where the larger displacement magnitude is obtainable, and thus larger amounts of droplets can be stably ejected from the plural nozzles 15.

Figure 16:
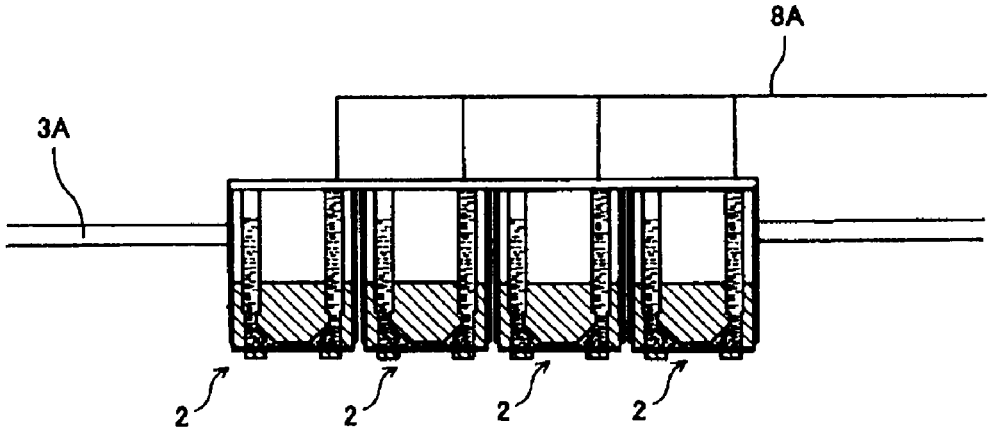
FIG. 16 is a schematic illustrative view that explains specific application of the toner production apparatus.

FIG. 11 exemplarily shows one droplet ejection unit 2; preferably, droplet ejection units 2 in a number of 100 to 1,000 (four in FIG. 16) are aligned and disposed at the upper side 3A of the particle forming portion 3 (drying/solidifying device, drying/solidifying step), and the toner ingredient-containing liquid 10 is supplied to the droplet ejection units 2 from a pipe line 8A through the raw material-containing portion 7 (common reservoir), thereby larger amounts of droplets can be ejected to enhance production efficiency.

Droplet Formation Mechanism

The mechanism to form droplets will be explained with respect to the droplet ejection unit 2 as the droplet forming device in the following.

In the droplet ejection unit 2, as described above, the thin film 12 is periodically vibrated by way of propagating the vibration, occurred at the vibrating device 13 as a mechanical vibrating device, to the thin film 12 with plural nozzles 11 adjacent to the reservoir, the plural nozzles 11 are disposed at the region of relatively large area (ϕ: 1 mm or more), and droplets are formed and discharged stably from the plural nozzles 11.

Figure 17:
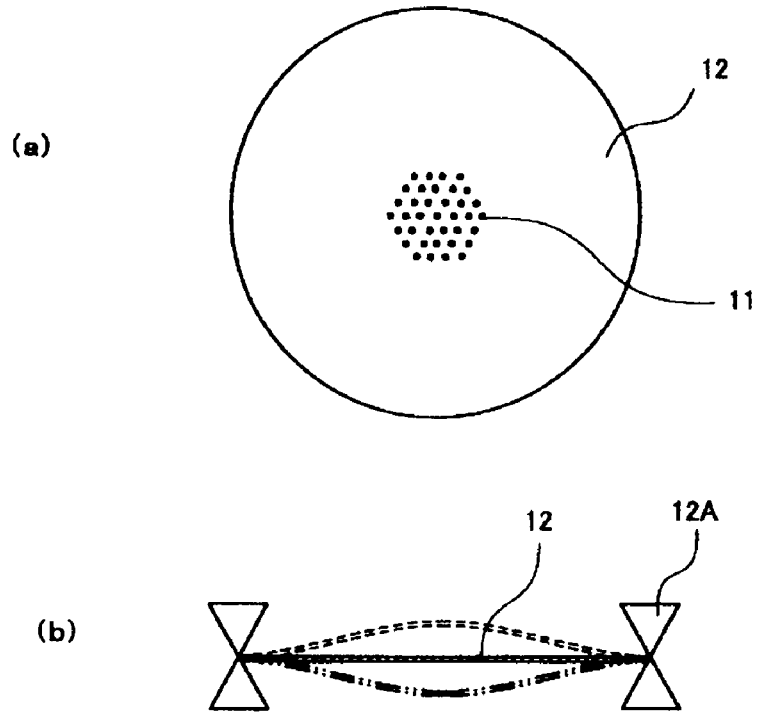
FIG. 17 is a schematic illustrative view that explains operational principle to form droplets in the droplet ejection unit.

When a simple circular film 12 is fixed at its periphery 12A as shown in FIG. 17, the periphery is the node in the fundamental vibration, and the vibration represents the cross-sectional shape in which the displacement ΔL is the largest ΔLmax at the center O of the thin film, and the thin film periodically vibrates up and down.

Figure 19:
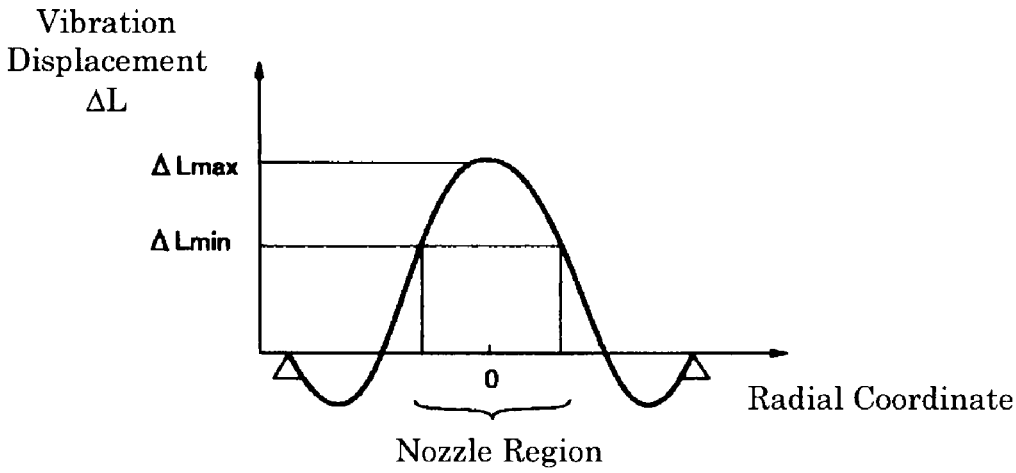
FIG. 19 is an illustrative view that explains a second vibration mode.
Figure 20:
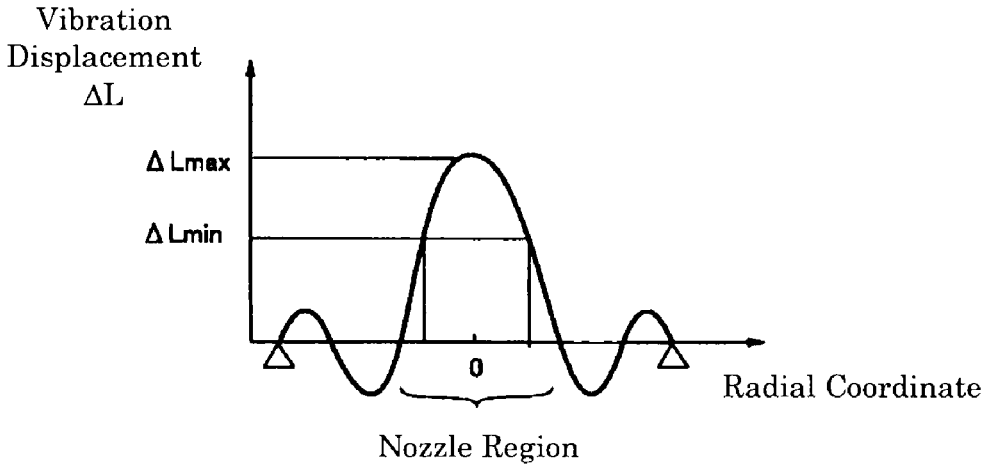
FIG. 20 is an illustrative view that explains a third vibration mode.
Figure 21:
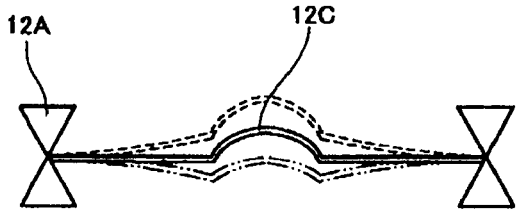
FIG. 21 is an illustrative view in which a convex portion is formed at the central portion of the thin film.

It is also known that the vibration may be of higher order modes as shown in FIGS. 19, 20. These modes represent deformed shapes of substantially axial symmetry in which one or more concentric circle nodes exist in the circular film. When the central portion is formed into a convex shape 12*c* as shown in FIG. 21, the progressing direction of droplets can be controlled and the vibration amplitude can be adjusted.

The vibration of the circular thin film generates an acoustic pressure Pac, which being proportional to vibration velocity Vm of the film, at the liquid near nozzles disposed at various sites of the circular film. It is known that the acoustic pressure generates as a counteraction of radiation impedance Zr of a medium (toner ingredient-containing liquid), and the acoustic pressure is expressed as a product of the radiation impedance Zr and the vibration velocity Vm of the film as shown by Equation (2) below.

$$Pac(r,t)=Zr\times Vm(r,t): \qquad \text{Equation (2)}$$

The vibration velocity Vm of the film periodically varies with time thus a function of time, and may represent various periodical variations such as sine curve and rectangular wave. The vibration direction and the vibration displacement are different at various sites of films, as described above, and Vm is also a function of position coordinate on films. The vibration mode of the films is axial symmetry in the present invention, thus the function is substantially of radius coordinate.

As described above, an acoustic pressure generates in proportion to a distributed vibration displacement velocity of films, and the toner ingredient-containing liquid is ejected to gas phase correspondingly to periodical variation of the acoustic pressure.

The toner ingredient-containing liquid, ejected periodically to gas phase, forms spherical bodies due to the difference of surface tensions at the liquid phase and the gas phase, thereby the liquid is made into droplets periodically.

The vibrational frequency of films capable of forming droplets is the range of 20 kHz to 2.0 MHz, more preferably the range of 50 kHz to 500 kHz. When the vibrational frequency is above 20 kHz, the dispersion of fine particles such as of pigments and waxes may be promoted in the toner ingredient-containing liquid.

When the displacement magnitude of the acoustic pressure is no less than 10 kPa, the effect to promote the dispersion of the fine particles is also derived adequately.

The diameter of the resulting droplets tends to increase as the vibration displacement comes to larger near the nozzles of the films, and when the vibration displacement is small, smaller droplets are formed or no droplets are formed. In order to lower the fluctuation of droplet sizes between nozzle sites, it is necessary to define the nozzle location where the vibration displacement of films is optimum.

Figure 18:
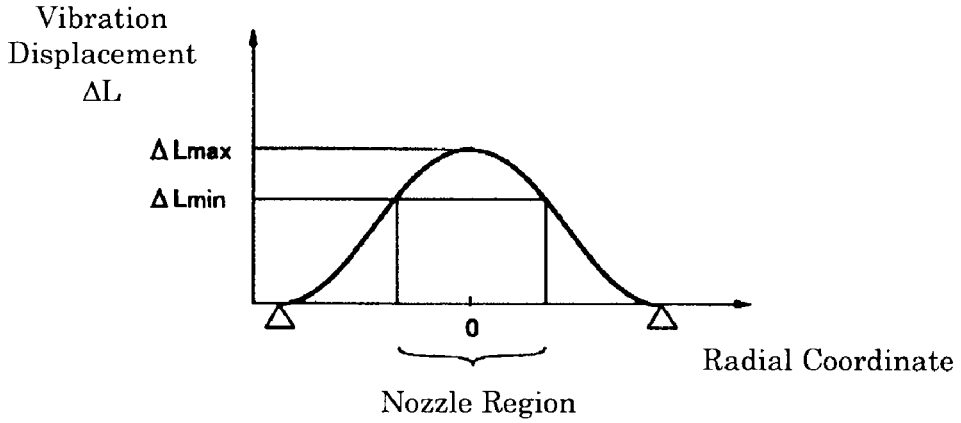
FIG. 18 is an illustrative view that explains a fundamental vibration mode.

It has been found in the present invention that when nozzles are placed at the sites where the ratio R of the maximum ΔLmax to the minimum ΔLmin (R=ΔLmax/ΔLmin) of the displacement ΔL, of vibrating direction of films near nozzles generated by the mechanical vibration device, is no more than 2.0, as explained by FIGS. 18 to 20, the fluctuation of the droplet sizes can be maintained within the range that is required for toner fine particles to provide high quality images.

Since the region to initiate the generation of satellite was similar at the region of viscosity of no more than 20 mPa·s and surface tension of 20 to 75 mN/m after changing the conditions of toner ingredient-containing liquid, it is necessary that the displacement magnitude of the acoustic pressure is no more than 500 kPa, more preferably 100 kPa or less.

Thin Film with Plural Nozzles

The thin film with plural nozzles is a member to eject the solution or dispersion of toner ingredients and to make droplets thereof, as described above.

The material of the thin film 12 and the shape of the nozzle 11 may be properly selected depending on the application; preferably, the thin film 12 is made of a metal plate of 5 to 500 μm thick and the aperture diameter of the nozzle 11 is 3 to 30 μm in order to generate fine droplets with significantly uniform particle diameters when ejecting droplets of the toner ingredient-containing liquid 10 from the nozzle. The aperture diameter of the nozzle 11 is defines to be the diameter in cases of true circles and the shorter diameter in cases of ellipses.

Third Embodiment

The third embodiment of the inventive method for producing electrophotographic toner, which being different from the periodic droplet forming methods described above, is a method to produce a toner with a uniform particle diameter distribution, in which a solution or a dispersion is fed to a reservoir in a constant rate, the raw material liquid is ejected to a particle forming space from plural through pores at the reservoir while vibrating the reservoir by a vibrating device that contact with a part of the reservoir, thereby the raw material liquid is made into droplets through from a column-like shape to a constricted condition.

Figure 22:
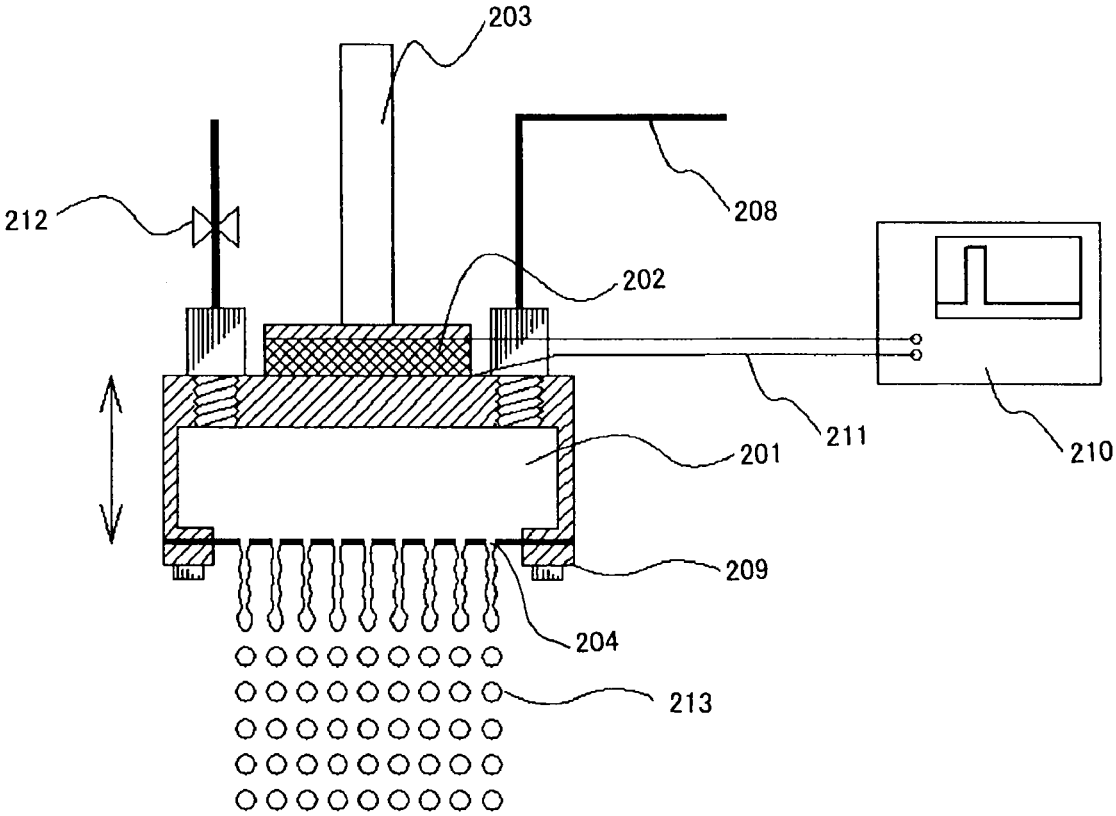
FIG. 22 is a schematic construction view that exemplarily shows a toner production apparatus for the inventive electrophotographic toner.

FIG. 22 is a schematic constitutional view of an apparatus to produce an electrophotographic toner that explains the third embodiment of the inventive method for producing an electrophotographic toner.

The reservoir is preferably made of metal members such as stainless steel and aluminum and has a pressure tightness of about 10 MPa in order to maintain the toner ingredient-containing liquid at a pressurized condition, but is not limited thereto. It is also preferred that a pipe 208 to supply the liquid to the reservoir is connected and a mechanism 209 to sustain the plate with through pores is provided, as shown in FIG. 22. A vibrating device 202 contacts with the reservoir to vibrate entirely the reservoir. It is preferred that the vibrating device is connected with a vibration generating device 210 and lead wires 211 and controlled therefrom. Preferably, the pressure in the reservoir is adjusted and an open valve 212 is provided to remove babbles therein in order to stabilize the liquid columns.

It is preferred for the vibrating device 202 that the reservoir with through pores is entirely excited to vibrate by one vibrating device.

The vibrating device 202 to vibrate the reservoir 201 may be properly selected without particular limitations as long as capable of vibrating surely at a constant frequency; preferably, the through pores are vibrated at a constant frequency by means of expansion and construction of piezoelectric bodies from the viewpoint described above.

The piezoelectric bodies perform to transfer an electric energy to a mechanical energy; specifically, application of voltages leads to expansion or construction, which enables to vibrate the through pores.

Examples of the piezoelectric body include piezoelectric ceramics such as lead zirconium titanate (PZT), which typically exhibit a small displacement magnitude, thus are laminated in use. The other piezoelectric materials are exemplified by piezoelectric polymers such as polyvinylidene fluoride (PVDF) and single crystals such as of quartz, $LiNbO_3$, $LiTaO_3$, and $KNbO_3$.

The constant frequency described above may be properly selected depending on the application; preferably, the frequency is 100 kHz to 10 MHz, more preferably 200 kHz to 2 MHz in view of generating fine droplets with significantly uniform particle diameters.

The vibrating device 202 contacts with the reservoir, and a plate with the through pores is supported by the reservoir. The vibrating device and the plate with the through pores are preferably disposed in parallel from the viewpoint of providing the liquid columns ejected from the through pores with uniform vibration, and the inclination therebetween is preferably within 10° even if vibration processes cause some deformation.

The through pore 204 may be only one for producing particles, preferably, plural through pores are provided and droplets ejected from the through pores are dried using one solvent-removing device from the viewpoint of effectively producing fine droplets having significantly uniform particle diameters.

It is preferred for still higher productivity that plural reservoirs having the vibrating device are provided. The productivity of toner particle depends on the number of droplets generating per unit time (frequency), and the product between the number of vibrating device(s) and the number of through pore(s) operative by one vibrating device. The number of through pore(s) operative by one vibrating device, i.e. the number of through pore(s) at one reservoir is as large as possible in view of operability, but unduly large number makes impossible to maintain the uniformity of particle diameters. Accordingly, the number of through pores, accompanied by one reservoir that is vibrated by one vibrating device, is preferably 10 to 10,000 in view of productivity and controllability, more preferably, 10 to 1,000 in order to generate more surely the fine droplets with significantly uniform particle diameters.

A supporting device 203 to fix and support a part of the vibrating device 202 is provided in order to fix the reservoir and the vibrating device to the apparatus. The material of the supporting device 203, which being not defined specifically, may be a rigid body such as of metals. In order to prevent disturbance of vibration at the reservoir due to surplus resonance, rubber materials or resin materials may be provided partially as a vibration buffer as required.

The through pore 204 of a droplet forming device is a member to eject the toner ingredient-containing liquid in a shape of liquid column as described above. The material and shape of the through pore may be properly selected depending on the application. It is preferred that the ejecting pore is formed of a metal plate of 5 to 50 μm thick and the aperture diameter is 1 to 40 μm from the viewpoint that fine particles of no more than 1 μm dispersed in the toner ingredient-containing liquid are prevented from clogging and also fine droplets are generated with significantly uniform particle diameters under a vibrational frequency of no less than 100 kHz. This is because a vibrational frequency of no less than 100 kHz is envisaged in view of productivity since the frequency region, capable of obtaining stably the droplets by action of producing droplets described above, decreases with increasing the diameter of the through pore. The aperture diameter is the diameter in cases of true circles and the shorter diameter in cases of ellipses.

The device to feed liquid to the common liquid chamber is preferably constant rate pumps such as tube pumps, gear pumps, rotary pumps, and syringe pumps, and also pumps to pressurize and feed by use of compressed air etc. The common liquid chamber is filled with the toner ingredient-containing liquid by the device to feed liquid and further pressurized to a pressure at which droplets can be formed. The liquid pressure may be measured by a pressure gauge attached to pumps or specific pressure sensors.

Device of Removing Solvent

The device to remove the solvent may be properly selected depending on the application; preferably, a dry gas A is flowed toward the same direction with the ejecting direction of droplets 213 to generate a gas flow, then the droplets 213 are transported within the solvent removing apparatus and the solvent in the droplets 213 is removed during the transportation thereby to form toner particles. The "dry gas" means a gas of which the dew-point temperature is no higher than −10° C. under atmospheric pressure. The dry gas may be selected without particular limitations as long as capable of drying the droplets 6; preferable examples of the dry gas include air, nitrogen gas, etc.

The temperature of the dry gas is preferably high in view of drying efficiency. Even when the temperature of the drying gas is higher than the boiling point of the solvent, the resulting toner may be far from thermal damage since the temperature of droplets does not rise above the boiling point of the solvent in the constant rate region on the way of drying due to inherent properties of spray drying. However, since the toner ingredients may contain a thermoplastic resin, when the toner is exposed to the dry gas of higher than the glass transition temperature of the resin after drying in the constant rate region, the toner may cause thermal fusion or the shape may comes to spherical. It is therefore preferred that the temperature of the dry gas is optimized together with the amount of gas flow and the amount of ejected liquid so as to adjust the temperature of the dried product to less than 50° C.

The toner production apparatus in the present invention may be equipped with a decreasing drying device and a flash drying device separately. The decreasing drying device may be stirring and drying devices of conductive electric heating type, fluidized bed driers, moving bed driers, etc. The drying temperature at decreasing drying is preferably lower than the glass transition temperature of the resin in use as well as the melting temperature of the low molecular mass organic material, more preferably lower than 10° C. or more from these temperatures.

Toner Collecting Portion

The toner collecting portion is a member that is disposed at the bottom of the apparatus for producing toner particles with an aim to effectively collect and convey toners.

The configuration of the toner collecting portion may be properly selected as long as capable of collecting the toner; preferably, the toner collecting portion has a taper face where the opening diameter gradually decreases as shown figures, and toner particles T are transported from the outlet with a opening diameter smaller than that of the inlet to a toner storage container by way of using dry gas A to form gas flow and making use of the gas flow.

The transporting method may pressure-feed the toner particles T by the dry gas or suck the toner particle T from the side of the toner storage container.

The flow of the dry gas is preferably a swirling current in view of transporting surely the toner particles by generating a centrifugal force.

The toner collecting portion and the toner collecting container are formed of an electrically conductive material and connected to earth in view of effectively transporting the toner particles. The toner production apparatus is of an explosion-proof design.

Other Steps

The inventive toner may be included external additives as required. The step to mix an external additive may be carried out with the decreasing drying step at the same time, which can simplify the entire steps.

Operation

In accordance with the inventive method for producing electrophotographic toner, the number of droplets produced per one through pore and per second is very large such as from several ten thousands to several millions and the through holes are unlikely to be clogged. Therefore, the droplets can be produced with very uniform droplet diameters and sufficient productivity, thus the method is advantageously suited for producing toners.

The inventive apparatus for forming electrophotographic image will be explained with reference to figures in the following.

Figure 23:
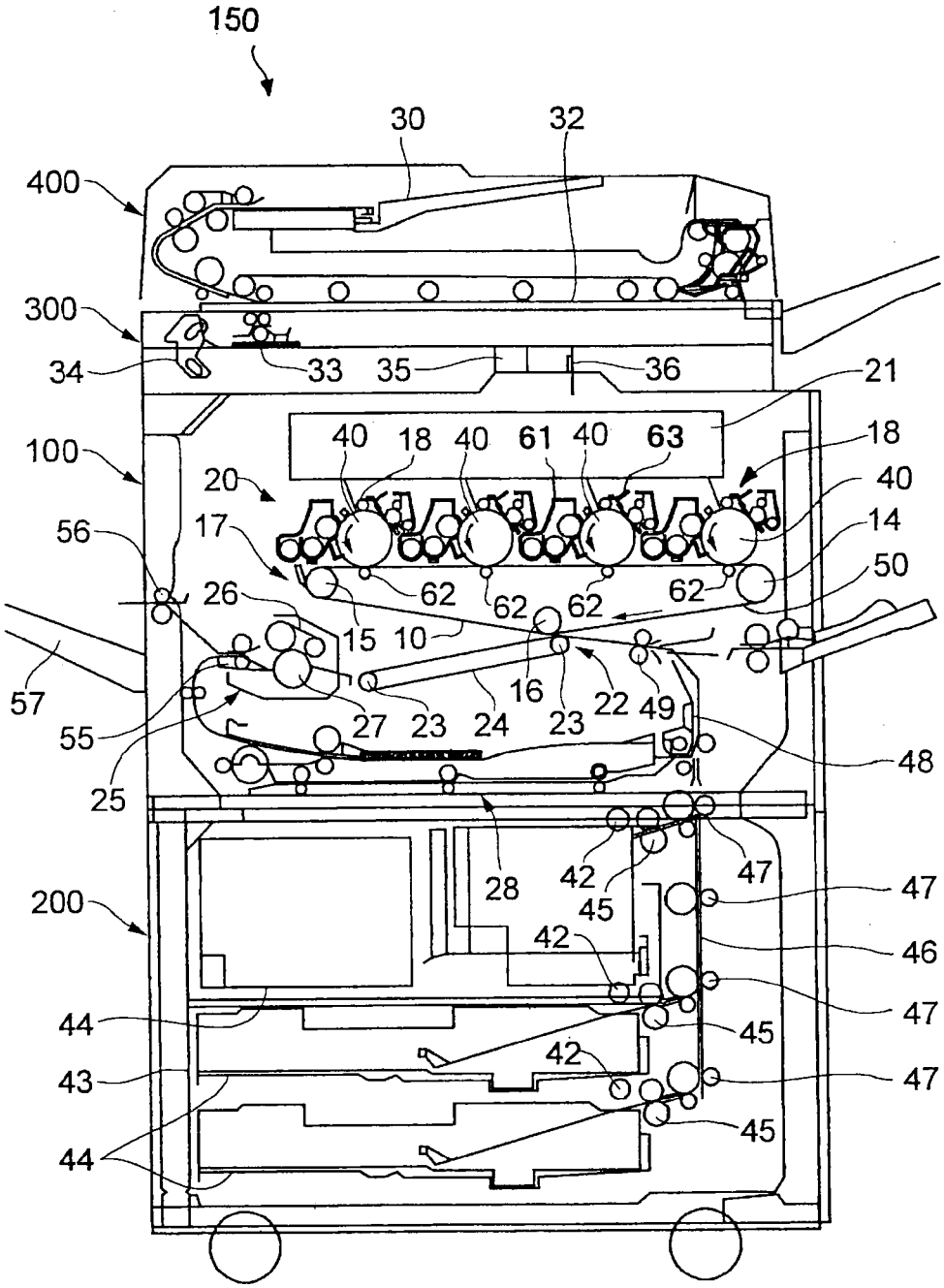
FIG. 23 is a schematic construction view that exemplarily shows an inventive apparatus for forming electrophotographic image.

FIG. 23 exemplarily shows a constitutional view of a color image forming apparatus that is an embodiment of the inventive apparatus for forming electrophotographic image. The specific example is an electrophotographic copier of tandem indirect image transfer system; the inventive apparatus for forming electrophotographic image may be applied to electrophotographic systems with two-component developers, thus the present invention should not be defined thereto. The apparatus is equipped with a copying machine main body 100, a paper feed table 200 on which the copying machine main body 100 is placed, a scanner 300 (reading optical system) arranged on the copying machine main body 100, and an automatic document feeder (ADF) 400 arranged on the scanner 300. The copying machine main body 100 is provided with an endless-belt intermediate transfer member 10 extending in crosswise direction at the central area. The intermediate transfer member 10 shown in FIG. 23 is spanned around three support rollers 14, 15 and 16 and is capable of rotating and moving in a clockwise direction in FIG. 23. This apparatus includes an intermediate transfer cleaning device 17, on the left side of the second support roller 15 among the three rollers, that removes residual toners on the intermediate transfer member 10 after image-transfer. Above the intermediate transfer member 10 spanned between the first and second support rollers 14 and 15, yellow, cyan, magenta, and black image-forming devices 18 are arrayed in parallel in a moving direction of the intermediate transfer member 10 to thereby constitute a tandem image forming unit 20. The apparatus further includes an exposing device 21 directly above the tandem image forming unit 20, and a secondary transfer 22 below the intermediate transfer member 10 as shown in FIG. 23. The secondary transfer 22, shown in FIG. 5 comprises an endless belt serving as a secondary transfer belt 24 spanned around two rollers 23. The secondary transfer belt 24 is pressed on the third support roller 16 with the interposition of the intermediate transfer member 10 and is capable of transferring an image on the intermediate transfer member 10 to a sheet. An image-fixing device 25 is arranged on the side of the secondary transfer 22 and is capable of fixing a transferred image on the sheet. The image-fixing device 25 comprises an endless image-fixing belt 26 and a pressure roller 27 pressed on the image-fixing belt 26. The secondary transfer 22 also performs to convey the image-transferred sheet to the image-fixing device 25. The apparatus shown in FIG. 23 also includes a sheet reverser 28 below the secondary transfer 22 and the image-fixing device 25 in parallel with the tandem image forming unit 20. The sheet reverser 28 is capable of reversing the sheet so as to form images on both sides of the sheet. A copy is made using the color electrophotographic apparatus in the following manner. Initially, a document is placed on a document platen 30 of the automatic document feeder 400. Alternatively, the automatic document feeder 400 is opened, the document is placed on a contact glass 32 of the scanner 300, and the automatic document feeder 400 is closed to press the document. At the push of a start switch (not shown), the document, if any, placed on the automatic document feeder 400 is transported onto the contact glass 32. When the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the document. At the push of the start switch (not shown), a drive motor (not shown) rotates and drives one of the support rollers 14, 15 and 16 to thereby allow the residual two support rollers to rotate following the rotation of the one support roller to thereby rotatably convey the intermediate transfer member 10. Simultaneously, the individual image forming device 18 rotates their photoconductors 40 to thereby form black, yellow, magenta, and cyan monochrome images on the photoconductors 40, respectively. With the conveying intermediate transfer member 10, the monochrome images are sequentially transferred to form a composite color image on the intermediate transfer member 10. Separately at the push of the start switch (not shown), one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copying machine main body 100 and are bumped against a resist roller 49. The resist roller 49 is rotated synchronously with the movement of the composite color image on the intermediate transfer member 10 to transport the sheet into between the intermediate transfer member 10 and the secondary transfer 22, and the composite color image is transferred onto the sheet by action of the secondary transfer 22 to thereby record a color image. The sheet bearing the transferred image is transported by the secondary transfer 22 into the image-fixing device 25, is applied with heat and pressure in the image-fixing device 25 to fix the transferred image, changes its direction by action of a switch blade 55, is ejected by an ejecting roller 56 and is stacked on an output tray 57. Alternatively, the sheet changes its direction by action of the switch blade 55 into the sheet reverser 28, turns therein, is transported again to the transfer position, followed by image formation on the back surface of the sheet. The sheet bearing images on both sides thereof is ejected through the ejecting roller 56 onto the output tray 57. Separately, the intermediate transfer cleaning device removes a residual toner on the intermediate transfer member 10 after image transfer for another image forming procedure by the tandem image forming unit 20.

Figure 24:
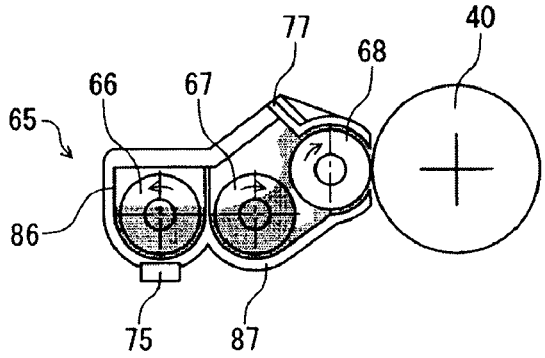
FIG. 24 is a schematic construction view that exemplarily shows an image forming portion of the inventive apparatus for forming electrophotographic image.

Each of the image forming devices 18 in the tandem image forming unit 20 is equipped with a charging device 60, a developing device 61, a primary transfer device 62, etc. around the drum-like photoconductor 40. The photoconductor cleaning device 63 is equipped with at least a cleaning blade. The developing device 61 is equipped with a stirring screw 66 at the side of supplying toners and a stirring screw 67 at the side of developer bearing member as a device to stir and convey developers, a developer bearing member 68 (developing roller), and a doctor blade, within a developer container 65 as shown in FIG. 24. A toner is supplied from a toner supplying device (not shown) to a supplying inlet (not shown) at the outer wall of the first developer-stirring chamber 86. The stirring screw 66 at the side of supplying toners stirs and conveys a toner, supplied from the toner supplying device, and a developer (two-component developer containing a magnetic particle and a toner) in the developer container 65. The stirring screw 67 in the second developer-stirring chamber 87 (side of developer bearing member) stirs and conveys a developer in the developer container 65 (hereinafter the second developer-stirring chamber is referred to as "developer-stirring chamber"). The stirring chamber of supplying side and the developer stirring chamber are partitioned by a division plate 80, and openings are provided at both sides to transfer developers. The developer in the developer stirring chamber is taken up by the developing sleeve 68, is controlled for the amount by the doctor blade, and is supplied to a sliding portion with a photoconductor of a latent image bearing member; at this stage, the developer is applied a highest sliding and fractionating force from the doctor blade. FIG. 24 also shows a toner concentration sensor 77.

Figure 25:
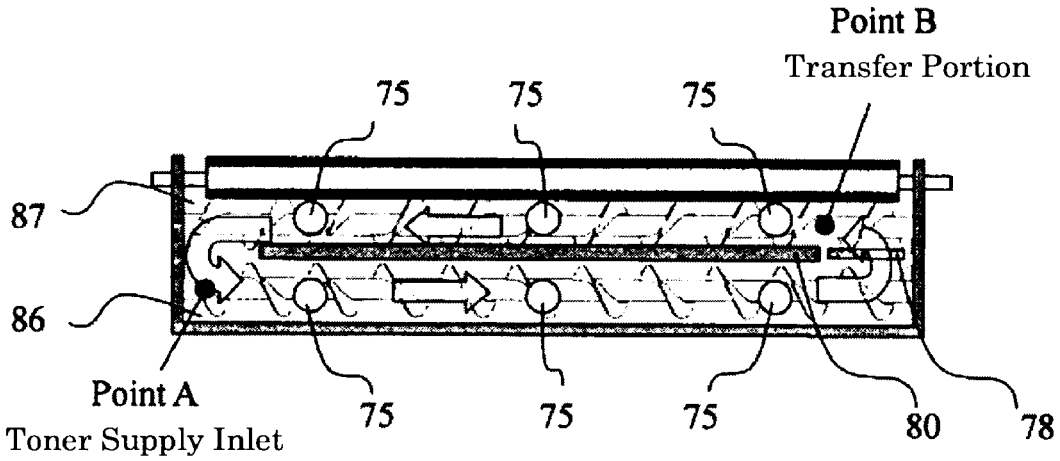
FIG. 25 is a schematic construction view that exemplarily shows a developing portion of the inventive apparatus for forming electrophotographic image.
Figure 26:
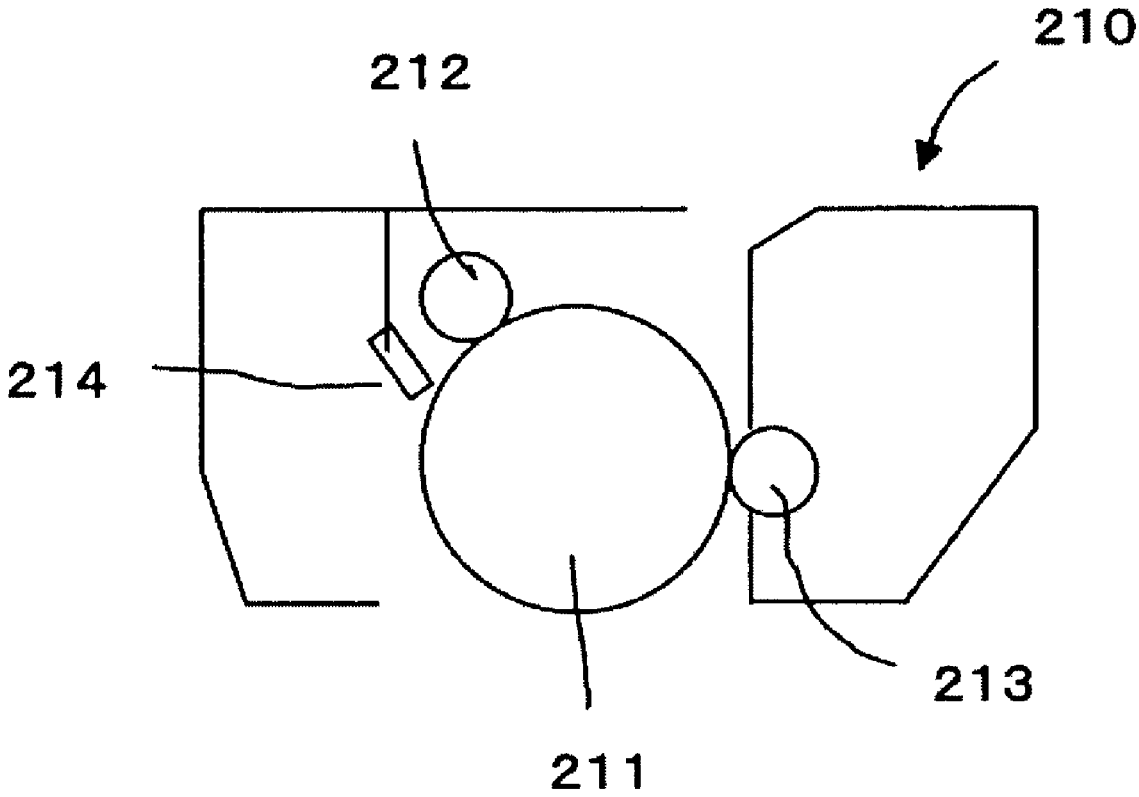
FIG. 26 is a schematic construction view that exemplarily shows an inventive process cartridge.

FIG. 25 shows the schematic configuration of a process cartridge that utilizes the inventive electrophotographic toner. There appear a member to control developer path 78 and a division plate 80 in FIG. 25. FIG. 26 shows an entire process cartridge 210, a photoconductor 211, a charging device 212, a developing device 213, and a cleaning device 214.

In the present invention, plural constructional elements among the photoconductor 211, the developing device 213, and the cleaning device 214, etc. are consolidated as a process cartridge, and the process cartridge is detachably mounted to main bodies of image forming apparatuses such as copiers and printers.

In the image forming apparatuses equipped with the inventive process cartridge, photoconductors are driven to rotate under a predetermined circumferential velocity. The photoconductors are uniformly charged to a certain positive or negative voltage at the circumferential surface by a charging device, then exposed by image light from image exposing devices such as of slit exposure and laser beam scanning exposure. In this way, electrostatic latent images are formed sequentially on the circumferential surface of photoconductors, the resulting electrostatic latent images are developed using toners by developing devices, and the developed toner images are sequentially transferred by transferring devices onto transfer materials fed from paper feed portions between the photoconductors and the transferring devices in synchronization with photoconductors. The transfer materials, onto which images being transferred, are separated from the surface of photoconductors and printed out from the apparatuses as copies. The surface of photoconductors after image transfer are cleaned for the remaining toners by cleaning devices having at least a blade cleaning member and charge-eliminated, then the photoconductors are repeatedly used for forming images.

EXAMPLES

The present invention will be explained with reference to Examples, but to which the present invention should in no way be limited. In the descriptions below, all parts and percentages are expressed by mass unless indicated otherwise.

Preparation of Colorant Dispersion Liquid

A dispersion of carbon black as a colorant was initially prepared.

Sixteen parts of carbon black (Regal 400, by Cabot Co.) and 3 parts of a dispersant for pigments were primarily dispersed in 81 parts of ethyl acetate using a mixer with stirring blades. The dispersant for pigments was Ajisper PB821 (by Ajinomoto Fine-Techno Co.). The resulting primarily dispersed liquid was finely dispersed by action of intense shear force using a Dyno mill to completely remove agglomerates thereby to prepare a secondarily dispersed liquid, which was then passed through a filter (made of PTFE) having fine pores of 0.5 μm, thereby a liquid dispersed to submicron range was prepared.

Preparation of Wax Dispersion Liquid

Next, a dispersion liquid, containing a resin as a binder resin and a wax, of the ingredients shown below was prepared.

Four hundred and forty parts of a polyester resin (by Kao Co., RN-289) as a binder resin, 100 parts of a paraffin wax (HPE-11), and 60 parts of a wax dispersant (by Sanyo Chemical Industries, Ltd.) were dispersed in 900 parts of ethyl acetate by stirring for 10 minutes using a mixer with stirring blades in a similar way as preparing the colorant dispersion liquid, then further dispersed using a Dyno mill. The dispersant at this stage was filtered through a filter (made of PTFE) having fine pores of 0.5 μm in a similar way as preparing the colorant dispersion liquid described above.

Preparation of Solution A of Resin and Low Molecular Mass Organic Material

Ninety parts of a polyester resin (by Kao Co., RN-289, Tg: 63.6° C., Tm: 106.1° C.) as a binder resin and 10 parts of Eversorb 75 (by Everlight Chemical Industrial Co. TW, melting temperature: 152° C., molecular mass: 357.5) as a low molecular mass organic material were dissolved in 400 parts of ethyl acetate to prepare a solution A.

Preparation of Solution B of Resin and Low Molecular Mass Organic Material

A solution B was prepared in the same manner as the solution A except that 92 parts of the polyester resin (by Kao Co., RN-289, Tg: 63.6° C., Tm: 106.1° C.) and 8 parts of glycerin monostearate (by Matsumoto Yushi-Seiyaku Co., B-M1, melting temperature: 68° C., molecular mass: 358.5) as a low molecular mass organic material were used.

Preparation of Solution C of Resin and Low Molecular Mass Organic Material

A solution C was prepared in the same manner as the solution A except that 84 parts of the polyester resin (by Kao Co., RN-289, Tg: 63.6° C., Tm: 106.1° C.) and 16 parts of 1,2-bis(3,4-dimethylphenyl)ethane (by Adeka Co., Y-7, melting temperature: 90° C., molecular mass: 238.4) as a low molecular mass organic material were used.

Preparation of Solution D of Resin and Low Molecular Mass Organic Material

The solution B and the solution C were mixed and stirred in a ratio of 1:1 to prepare a solution D.

Preparation of Solution E of Resin and Low Molecular Mass Organic Material

Eighty five parts of a styrene-acrylic copolymer (by Nippon Carbide Industries Co., NCI #52076, Tg: 58.6° C., Tm: 153.7° C.) as a binder resin, and 8 parts of stearic acid (by NOF Co., NAA-180, melting temperature: 65° C., molecular mass: 284.5) and 7 parts of Eversorb 74 (by Everlight Chemical Industrial Co. TW, melting temperature: 80° C., molecular mass: 351) as low molecular mass organic materials were dissolved in 400 parts of ethyl acetate to prepare a solution E.

Preparation of Solution F of Resin and Low Molecular Mass Organic Material

One hundred parts of a polyester resin (by Kao Co., RN-289, Tg: 63.6° C., Tm: 106.1° C.) as a binder resin was dissolved in 400 parts of ethyl acetate to prepare a solution F.

Preparation of Solution G of Resin and Low Molecular Mass Organic Material

A solution G was prepared in the same manner as the solution B except that the low molecular mass organic material of the solution B was changed into a phosphate ester (by Daihachi Chemical Industry Co., PX-200, melting temperature: 94° C., molecular mass: 558).

Preparation of Solution H of Resin and Low Molecular Mass Organic Material

A solution H was prepared in the same manner as the solution B except that the polyester resin of the solution A as the binder resin was changed into a polyester resin (by Kao Co., RN-290, Tg: 59.8° C., Tm: 149.2° C.). A minute amount of insoluble gel was partially observed in the solution H.

Preparation of Toner Ingredient-Containing Liquid A

Fifty parts of the colorant dispersion liquid, 75 parts of the wax dispersion liquid, 555 parts of the solution A, and 313 parts of ethyl acetate were mixed and stirred using a TK homomixer (by Tokushu Kika Kogyo Co.) at 7.5 m/sec for 1 minute to prepare a toner ingredient-containing liquid A. The moisture content of the toner ingredient-containing liquid A was less than 0.1% by mass.

Preparation of Toner Ingredient-Containing Liquid B

Fifty parts of the colorant dispersion liquid, 75 parts of the wax dispersion liquid, 544 parts of the solution B, and 310 parts of ethyl acetate were mixed and stirred using a TK homomixer (by Tokushu Kika Kogyo Co.) at 7.5 m/sec for 1 minute to prepare a toner ingredient-containing liquid B. The moisture content of the toner ingredient-containing liquid B was less than 0.1% by mass.

Preparation of Toner Ingredient-Containing Liquid C

Fifty parts of the colorant dispersion liquid, 595 parts of the solution C, and 202 parts of ethyl acetate were mixed and stirred using a TK homomixer (by Tokushu Kika Kogyo Co.) at 7.5 m/sec for 1 minute to prepare a toner ingredient-containing liquid C. The moisture content of the toner ingredient-containing liquid C was less than 0.1% by mass.

Preparation of Toner Ingredient-Containing Liquid D

Fifty parts of the colorant dispersion liquid, 568 parts of the solution D, and 192 parts of ethyl acetate were mixed and stirred using a TK homomixer (by Tokushu Kika Kogyo Co.) at 7.5 m/sec for 1 minute to prepare a toner ingredient-containing liquid D. The moisture content of the toner ingredient-containing liquid D was less than 0.1% by mass.

Preparation of Toner Ingredient-Containing Liquid E

Fifty parts of the colorant dispersion liquid, 588 parts of the solution E, and 199 parts of ethyl acetate were mixed and stirred using a TK homomixer (by Tokushu Kika Kogyo Co.) at 7.5 m/sec for 1 minute to prepare a toner ingredient-containing liquid E. The moisture content of the toner ingredient-containing liquid E was less than 0.1% by mass.

Preparation of Toner Ingredient-Containing Liquid F

Fifty parts of the colorant dispersion liquid, 75 parts of the wax dispersion liquid, 375 parts of the solution F, and 253 parts of ethyl acetate were mixed and stirred using a TK homomixer (by Tokushu Kika Kogyo Co.) at 7.5 m/sec for 1 minute to prepare a toner ingredient-containing liquid F. The moisture content of the toner ingredient-containing liquid F was less than 0.1% by mass.

Preparation of Toner Ingredient-Containing Liquid G

Fifty parts of the colorant dispersion liquid, 75 parts of the wax dispersion liquid, 544 parts of the solution G, and 310 parts of ethyl acetate were mixed and stirred using a TK homomixer (by Tokushu Kika Kogyo Co.) at 7.5 m/sec for 1 minute to prepare a toner ingredient-containing liquid G. The moisture content of the toner ingredient-containing liquid G was less than 0.1% by mass.

Preparation of Toner Ingredient-Containing Liquid H

Fifty parts of the colorant dispersion liquid, 75 parts of the wax dispersion liquid, 544 parts of the solution H, and 310 parts of ethyl acetate were mixed and stirred using a TK homomixer (by Tokushu Kika Kogyo Co.) at 7.5 m/sec for 1 minute to prepare a toner ingredient-containing liquid H. The moisture content of the toner ingredient-containing liquid H was less than 0.1% by mass.

Preparation of Toner Ingredient-Containing Liquid I

A toner ingredient-containing liquid I was prepared in the same manner as the toner ingredient-containing liquid B except that the colorant dispersion liquid and the wax dispersion liquid were not filtered through a filter having fine pores of 0.5 μm. The moisture content of the toner ingredient-containing liquid I was less than 0.1% by mass.

All of the toner ingredient-containing liquids were adjusted so as to have a solid content of 15% by mass. When the particle diameter of toners is controlled, the particle diameter of droplets ejected from nozzles naturally depends on the nozzle configuration. Therefore, in order to obtain an adequate particle diameter of toners, the particle diameter can be easily and simply adjusted by controlling the solid content, and thus the solid content is naturally decided depending on the nozzle in use and the intended particle diameter of toners.

Preparation of Base Toner

The resulting toner ingredient-containing liquids A to I were spray-dried using the apparatus for producing electrophotographic toner shown in FIG. 1 thereby to produce toner bases A to I, A' to I', and A" to I".

Specifically, as discussed above in terms of the inventive production methods, the toner ingredient-containing liquids were spray-dried using a nozzle head of vibration chamber (see FIG. 2) in a way that the toner ingredient-containing liquids were fed to a reservoir in a constant rate, the toner ingredient-containing liquids were ejected to a particle forming space from plural through pores at the reservoir while exciting to vibrate the reservoir, thereby the toner ingredient-containing liquids were made into droplets through from a column-like shape to a constricted condition, and the droplets were changed into solid particles, then the solid particles were subjected to decreasing drying at 50° C. in a fluidized bed drier thereby to produce the toner bases A to I.

In addition, toner bases A' to I' were produced by spray-drying the toner ingredient-containing liquids, using the liquid ejection unit (see FIGS. 3 to 11) of a mechanical longitudinal vibration device in place of the spray device using the nozzle head of vibration chamber, in a way that the toner ingredient-containing liquids were periodically ejected from plural nozzles of the thin film by way of vibrating the thin film with the plural nozzles provided at the reservoir of the toner ingredient-containing liquids by a mechanical vibrating device thereby to form droplets, then the resulting solid particles were subjected to decreasing drying at 50° C. in a fluidized bed drier thereby to produce the toner bases A' to I'.

Furthermore, the toner ingredient-containing liquids were spray-dried by the spray device with the ring-type liquid ejection unit (see FIGS. 12 to 17), then the resulting solid particles were subjected to decreasing drying at 50° C. in a fluidized bed drier thereby to produce the toner bases A" to I". The nozzle head can produce monodispersed particles in cases where liquids are not clogged.

Production stability of the resulting base toners was evaluated when producing the base toners. Specifically, each of the toner ingredient-containing liquids was continuously spray-dried in an amount of 10 kg to produce each toner base in an amount of 1.5 kg, and the initial flow rate I1 and the flow rate I2 after ejecting 10 kg was determined. A ratio I2/I1 of no less than 0.99 was evaluated to be highly stable as "A", and a ratio of I2/I1 of less than 0.99 was evaluated to be unstable as "B". The results of production stability and also particle size distribution, circularity, etc. of the toner bases A to I, A' to I', and A" to I" are shown in Table 1.

TABLE 1

| | toner base | [flow arte after ejecting 10 kg]/[initial flow rate] (%) | | number average particle diameter Dn (μm) | volume average particle diameter Dn (μm) | D4/Dn | circularity (%) | |
|---|---|---|---|---|---|---|---|---|
| cham- | A | 99.3 | A | 6.0 | 6.0 | 1.00 | 0.96 | A |
| ber | B | 99.3 | A | 6.0 | 6.0 | 1.00 | 0.97 | A |
| | C | 100 | A | 6.0 | 6.0 | 1.00 | 0.97 | A |
| | D | 100 | A | 6.0 | 6.0 | 1.00 | 0.96 | A |
| | E | 100 | A | 6.0 | 6.0 | 1.00 | 0.96 | A |
| | F | 99.2 | A | 6.0 | 6.0 | 1.00 | 0.99 | B |
| | G | 99.3 | A | 6.0 | 6.0 | 1.00 | 0.99 | B |
| | H | 69.1 | B | 5.6 | 6.2 | 1.11 | 0.96 | A |
| | I | 88.8 | B | 5.7 | 6.2 | 1.09 | 0.97 | A |
| horn | A' | 99.6 | A | 5.8 | 6.1 | 1.05 | 0.96 | A |
| | B' | 99.7 | A | 5.9 | 6.0 | 1.02 | 0.96 | A |
| | C' | 100 | A | 5.8 | 6.1 | 1.05 | 0.96 | A |
| | D' | 100 | A | 6.0 | 6.0 | 1.00 | 0.96 | A |
| | E' | 100 | A | 5.8 | 6.1 | 1.05 | 0.96 | A |
| | F' | 98.9 | A | 5.9 | 6.0 | 1.02 | 0.99 | B |
| | G' | 99.3 | A | 5.9 | 6.0 | 1.02 | 0.99 | B |
| | H' | 65.3 | B | 4.4 | 5.6 | 1.27 | 0.96 | A |
| | I' | 81.2 | B | 4.6 | 5.9 | 1.28 | 0.96 | A |

TABLE 1-continued

| | toner base | [flow arte after ejecting 10 kg]/[initial flow rate] (%) | | number average particle diameter Dn (μm) | volume average particle diameter Dn (μm) | D4/Dn | circularity (%) | |
|---|---|---|---|---|---|---|---|---|
| ring | A" | 99.8 | A | 5.8 | 6.1 | 1.05 | 0.96 | A |
| | B" | 100 | A | 5.8 | 6.1 | 1.05 | 0.96 | A |
| | C" | 100 | A | 5.7 | 6.1 | 1.07 | 0.96 | A |
| | D" | 100 | A | 5.8 | 6.1 | 1.05 | 0.96 | A |
| | E" | 100 | A | 5.7 | 6.1 | 1.07 | 0.96 | A |
| | F" | 100 | A | 5.8 | 6.1 | 1.05 | 0.99 | B |
| | G" | 99.6 | A | 5.9 | 6.0 | 1.02 | 0.99 | B |
| | H" | 52.1 | B | 5.2 | 5.8 | 1.12 | 0.96 | A |
| | I" | 76.5 | B | 4.6 | 6.2 | 1.35 | 0.96 | A |

The toner bases with insufficient ejection stability were ultimately monodispersed such that the particle diameter distribution was no more than 1.07. The toner bases H, H', H", I, I', and I" with insufficient ejection stability had ultimately a broad particle diameter distribution of no less than 1.09. The toner bases F, F', F", G, G', and G" had approximately a truly spherical shape although the ejection was stable.

Toner Production

To each of the toner bases A to I, A' to I', and A" to I", 1.5 parts of H1303 (hydrophobic silica) and 0.8 part of MA150AI (hydrophobic titania) were mixed as external additives based on 100 parts of the toner base using a Henschel mixer thereby to produce toners A to I, A' to I', and A" to I". The external additives were added to impart flowability and to adjust charging property. It has been confirmed that although some additives perform as a cleaning aid but the two additives described above in this Example have no or less effect thereof.

Developer Production

The inventive toners, which being unnecessary to be defined as either one-component developer or two-component developer, were evaluated as for two-component developers A to I, A' to I', and A" to I" after blending with the carrier shown below in this Example.

Carrier core material: spherical ferrite particle, average particle diameter: 35 μm coat material: mixture of a silicone resin and a melamine resin Evaluation in Actual Apparatus Evaluation was carried out using a tandem color electrophotographic apparatus (Imagio Neo C350, by Ricoh Co.) as follows. The developers A to G, A' to G', and A" to G" were filled into the black developing unit of the apparatus for every evaluation, and cleaning stability was evaluated by way of 10,000 sheets of running at image occupation rate of 5% using 6000 paper (by Ricoh Co.).

As for the developers F, F', F", G, G', and G", which being prepared from toner bases F, F', F", G, G', and G" having a circularity of no less than 0.98 as shown in Table 1, cleaning defect, which affecting images, had generated such as steaks and filming on photoconductors due to scraping from cleaning blades. The developers B, B', B", D, D', and D" had lower limit fixing temperatures of 20° C. lower than those of developers A, A', A", C, C', and C" that used the same resins, and exhibited proper fixability respectively. The developers C, C', C", D, D', D", E, E', and E", which being prepared from toner ingredient-containing liquid with no wax dispersion, represented sufficient releasing ability and occurred no problems induced therefrom.

Residual solvent was measured in terms of toners A to I, A' to I', and A" to I", consequently, minute amount of ethyl acetate was detected from all of the toners. Toners A to I, A' to I', and A" to I" were dissolved respectively in an amount of 20 parts in 100 parts of ethyl acetate, and insoluble matters were separated using a centrifugal separator (by Kokusan Co., Takujyo Tahonka centrifugal H-40F) thereby to prepare toner solutions A to I, A' to I', and A" to I". Each of the toner solutions A to I, A' to I', and A" to I" was coated on aluminum-deposited PET film (50 μm thick) using a wire bar to a film thickness of 5 to 6 μm on the aluminum-deposited side, and the coating was dried into a film in a drier at 50° C. for 1 minute. The resulting films were observed and the results are shown below.

Condition of Coated Film toner ingredient-containing liquids A, A', A": coated film where crystals are dispersed in transparent resin film;

toner ingredient-containing liquids B, B', B": coated film where crystals are dispersed in transparent resin film;

toner ingredient-containing liquids C, C', C": coated film where crystals are dispersed in transparent resin film;

toner ingredient-containing liquids D, D', D": coated film where crystals are dispersed in transparent resin film;

toner ingredient-containing liquids E, E', E": coated film where crystals are dispersed in transparent resin film;

toner ingredient-containing liquids F, F', F": transparent coated film;

toner ingredient-containing liquids G, G', G": transparent coated film;

toner ingredient-containing liquids H, H', H": coated film where crystals are dispersed in transparent resin film;

toner ingredient-containing liquids I, I', I": coated film where crystals are dispersed in transparent resin film.

As described above, the inventive electrophotographic toners have relatively small particle diameters and represent adequate cleaning ability. The inventive method for producing electrophotographic toner can produce stably electrophotographic toners that have relatively small particle diameters and represent adequate cleaning ability.

What is claimed is:

1. A method for producing electrophotographic toner comprising:

spray-drying a toner ingredient-containing liquid, wherein the toner ingredient-containing liquid dissolves or disperses at least a resin, a low molecular mass organic material, and a colorant in an organic solvent, the resin is soluble in the organic solvent, the low molecular mass organic material is a crystalline compound or a composition of crystalline compounds that is soluble in the organic solvent, the toner ingredient-containing liquid contains substantially no particles having a particle diameter of 500 nm or more, the crystalline compound or the composition of crystalline compounds crystallizes upon the spray-drying to deform toner particles into a circularity of 0.93 or higher to 0.98 or less, and volume average particle diameter of the toner particles is 3.0 μm or higher to less than 7.0 μm, and the spray-drying comprises a step of periodically forming droplets, in which a toner ingredient-containing liquid is fed from a reservoir of the toner ingredient-containing liquid and periodically ejected from plural nozzles to form the droplets by way of vibrating a thin film, which being mounted at the reservoir and equipped with the plural nozzles, using a mechanical vibrating device, and a step of drying and solidifying droplets, in which the droplets of the toner ingredient-containing liquid are dried and solidified.

2. The method for producing electrophotographic toner according to claim 1, wherein the mechanical vibrating device has a vibrating face parallel to the thin film and the vibrating face longitudinally vibrates in a vertical direction.

3. The method for producing electrophotographic toner according to claim 1, wherein the mechanical vibrating device is a horn-type transducer.

4. The method for producing electrophotographic toner according to claim 1, wherein the mechanical vibrating device is a vibration generating unit having a configuration of circular ring that is disposed around the area of the nozzles of the thin film.

5. The method for producing electrophotographic toner according to claim 1, wherein vibrational frequency of the mechanical vibrating device is 20 kHz or higher to less than 2.0 MHz.

6. The method for producing electrophotographic toner according to claim 1, wherein water content of the toner ingredient-containing liquid is 0.3% by mass or less.

7. The method for producing electrophotographic toner according to claim 1, wherein the crystalline compound or the composition of crystalline compounds has a mass average molecular mass of 100 or higher to 2000 or less.

8. The method for producing electrophotographic toner according to claim 1, wherein the crystalline compound or the composition of crystalline compounds has a melting temperature of 50° C. or higher.

9. The method for producing electrophotographic toner according to claim 1, wherein at least one of the crystalline compounds among the crystalline compound and the composition of crystalline compounds has a melting temperature of 120° C. or less, and exhibits an effect to plasticize the resin through dissolving together with the resin at a temperature higher than the melting temperature.

10. The method for producing electrophotographic toner according to claim 1, wherein at least one of the crystalline compounds among the crystalline compound and the composition of crystalline compounds performs a releasing function without dissolving together with the resin, and has a melting temperature of 100° C. or less.

* * * * *